US008985687B2

(12) United States Patent
Mo

(10) Patent No.: US 8,985,687 B2
(45) Date of Patent: Mar. 24, 2015

(54) INFANT CHAIR APPARATUS

(71) Applicant: Xiao Long Mo, Kowloon (HK)

(72) Inventor: Xiao Long Mo, Kowloon (HK)

(73) Assignee: Wonderland Nurserygoods Company Limited, Hong Kong (HK)

( * ) Notice: Subject to any disclaimer, the term of this patent is extended or adjusted under 35 U.S.C. 154(b) by 63 days.

(21) Appl. No.: 13/852,208

(22) Filed: Mar. 28, 2013

(65) Prior Publication Data

US 2013/0257124 A1 Oct. 3, 2013

(30) Foreign Application Priority Data

Mar. 28, 2012 (CN) ..... 2012 1 0087485
Mar. 15, 2013 (CN) ..... 2013 1 0084093

(51) Int. Cl.

| | |
|---|---|
| ***A47C 3/02*** | (2006.01) |
| ***A47D 1/00*** | (2006.01) |
| ***A47D 1/08*** | (2006.01) |
| ***A47D 13/10*** | (2006.01) |

(52) U.S. Cl.

CPC .. *A47D 1/00* (2013.01); *A47D 1/08* (2013.01); *A47D 13/105* (2013.01)

USPC ..... 297/260.1

(58) Field of Classification Search

CPC .... A47C 3/025; A47C 3/0255; A47C 3/0252; A47D 1/08

USPC ..... 297/260.1, 258.1, 259.4, 268.2, 270.1

See application file for complete search history.

(56) References Cited

U.S. PATENT DOCUMENTS

| | | | | |
|---|---|---|---|---|
| 6,855,098 | B2 * | 2/2005 | Reitz et al. | 297/258.1 |
| 7,845,728 | B2 * | 12/2010 | Chen et al. | 297/274 |
| 7,946,650 | B2 * | 5/2011 | Gillett | 297/258.1 |
| 8,205,943 | B2 * | 6/2012 | Zhong | 297/274 |
| 8,366,193 | B2 * | 2/2013 | Lin | 297/261.1 |
| 8,746,794 | B2 * | 6/2014 | Oren et al. | 297/274 |
| 2006/0012230 | A1 * | 1/2006 | Kennedy et al. | 297/261.3 |
| 2007/0040431 | A1 | 2/2007 | Bapst et al. | |
| 2009/0284058 | A1 | 11/2009 | Gillett | |

FOREIGN PATENT DOCUMENTS

| | | | |
|---|---|---|---|
| CN | 101480306 | B | 5/2012 |
| EP | 0242140 | A2 | 10/1987 |
| EP | 0574958 | A1 | 12/1993 |
| WO | 9718392 | | 5/1997 |

* cited by examiner

*Primary Examiner* — Jose V Chen

(74) *Attorney, Agent, or Firm* — David I. Roche; Baker & McKenzie LLP

(57) ABSTRACT

An infant chair apparatus includes a support frame, a seat pivotally connected with the support frame about a pivot axis and provided with a coupling member, and a swing drive assembly connected with the seat and the support frame. The swing drive assembly includes a spring having a first end affixed with the support frame and a movable second end, wherein the spring is operable to apply a spring force that is converted into a driving torque applied on the coupling member to impart a swing motion to the seat, and a torque adjusting mechanism respectively connected with the second end of the spring and the coupling member, the torque adjusting mechanism being operable to adjust a position of the coupling member relative to the seat.

20 Claims, 26 Drawing Sheets

INFANT CHAIR APPARATUS

CROSS-REFERENCE TO RELATED APPLICATIONS

This application claims priority to Chinese Patent Application No. 201210087485.3 filed on Mar. 28, 2012, and to Chinese Patent Application No. 201310084093.6 filed on Mar. 15, 2013, the entirety of each of which is incorporated herein by reference.

BACKGROUND

1. Field of the Invention

The present inventions relate to infant chair apparatuses.

2. Description of the Related Art

Infant high chairs are commonly used to seat a young child so that a caregiver can conveniently serve a meal to the child. The high chair usually provides a stable support that cannot entertain the child. Therefore, there is a need for an infant chair apparatus that can entertain a child and address the foregoing issues.

SUMMARY

The present application describes infant chair apparatuses. In one embodiment, the infant chair apparatus includes a support frame, a seat pivotally connected with the support frame about a pivot axis and provided with a coupling member, and a swing drive assembly connected with the seat and the support frame. The swing drive assembly includes a spring having a first end affixed with the support frame and a movable second end, wherein the spring is operable to apply a spring force that is converted into a driving torque applied on the coupling member to impart a swing motion to the seat, and a torque adjusting mechanism respectively connected with the second end of the spring and the coupling member, the torque adjusting mechanism being operable to adjust a position of the coupling member relative to the seat.

DETAILED DESCRIPTION OF THE EMBODIMENTS

Figure 1:
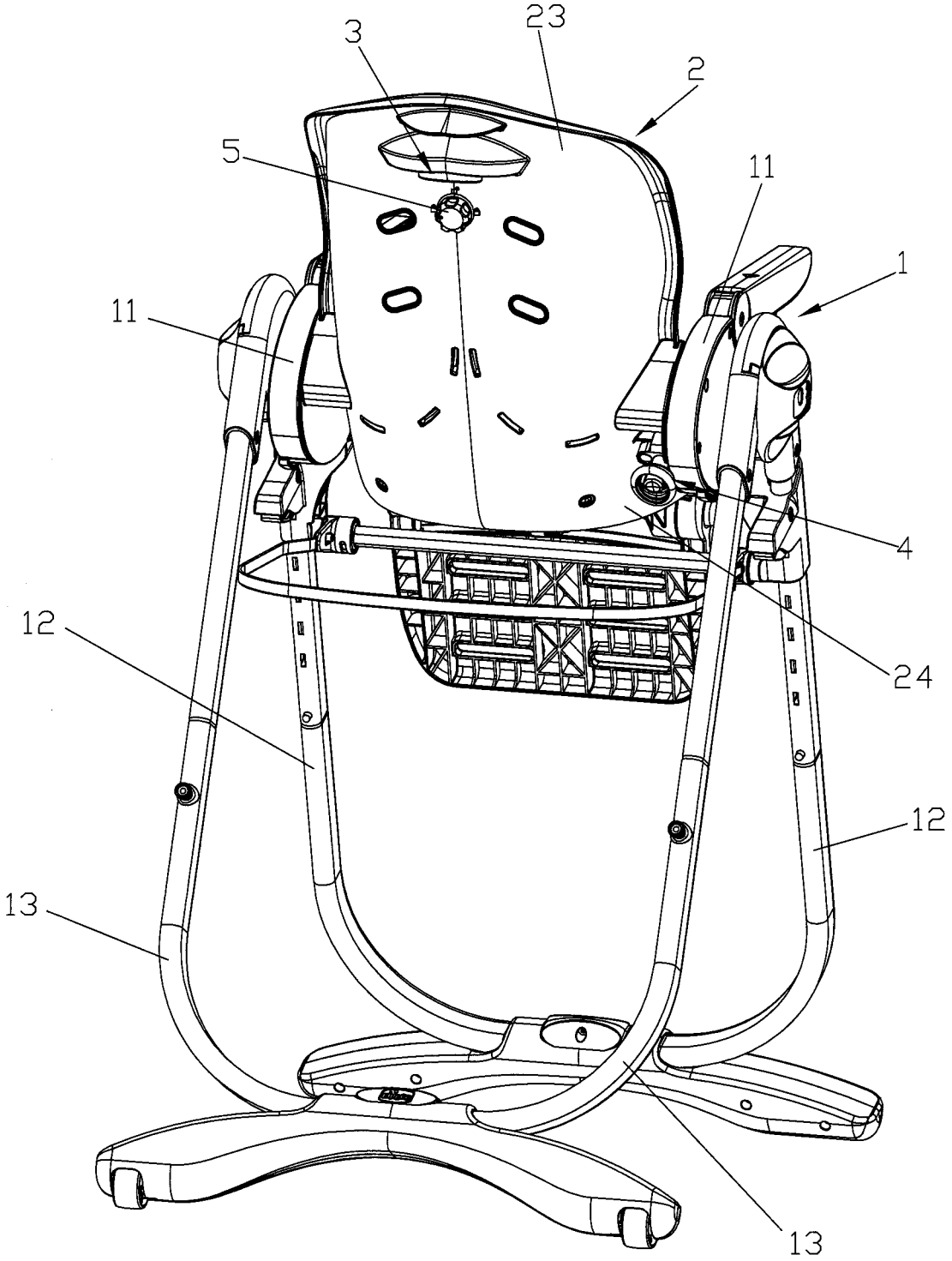
FIG. 1 is a schematic view illustrating an embodiment an infant chair apparatus.

FIGS. 1-13 are schematic views illustrating an embodiment of an infant chair apparatus. Referring to FIGS. 1 and 4, the infant chair apparatus can include a support frame 1, and a seat 2 pivotally connected with the support frame 1. A recline adjusting mechanism 3 and a swing drive assembly 4 may also be assembled with the seat 2 and the support frame 1. The seat 2 can be provided with a switch 5 operable to switch between a swing enabling state where the switch 5 holds the recline adjusting mechanism 3 in an unlocking state for allowing a swing motion of the seat 2, and a swing disabling state where the recline adjusting mechanism 3 is allowed to operate between the unlocking and locking state to adjust and lock the seat 2 in place. When the switch 5 is in the swing disabling state, the chair apparatus can be typically used as a high chair. When the switch 5 is in the swing enabling state, locking movement of the recline adjusting mechanism 3 is blocked so that the seat 2 can freely swing driven by the swing drive assembly 4.

The support frame 1 can include a housing 11 arranged at each of the left and right side, and a front leg frame 12 and a rear leg frame 13 having upper ends respectively assembled with the housings 11. The leg frames 12 and 13 can have an extended length so that the infant chair apparatus may be used as a high chair. Left and right side portions of the seat 2 can be respectively connected pivotally with the housings 11 via pivot shafts 6 that define a transversal pivot axis about which the seat 2 can rotate relative to the support frame 1.

Referring to FIGS. 1, 2, 10 and 11, the recline adjusting mechanism 3 can include a handle 31, two flexible transmission members 32, and two latches 33 that respectively are assembled adjacent to the housings 11 and connected with the two transmission members 32. The handle 31 can be assembled with the backrest 23 of the seat 2, and can be movable vertically along the backrest 23. The transmission members 32 can be cables, cords, wires, strips, and the like. Each transmission member 32 can have a first end connected with the handle 31, and a second end connected with one latch 33 associated therewith. The two latches 33 can be disposed at the left and right sides of the seating portion 24 near a lower end of the backrest 23. The latches 33 can be movable along a transversal axis to engage with and disengage from any of a plurality of locking openings 34 formed through the housings 11. A spring 35 assembled with each latch 33 can be operable to bias the latch 33 to engage with the locking openings 34.

When the recline adjusting mechanism 3 is in the locking state, each of latch 33 can be respectively biased by the spring 35 associated therewith to engage with one of the locking openings 34 to hold the seat 2 at a desired inclination relative to the support frame 1. Rotation of the seat 2 about the pivot axis of the pivot shafts 6 can be thereby blocked.

When the inclination of the seat 2 is to be adjusted, an operating pad 312 arranged at an upper end of the handle 31 can be pulled upward so as to displace the handle 31, which drives displacement of the latches 33 via the transmission members 32 to disengage from the locking openings 34. The recline adjusting mechanism 3 can be thereby unlocked, and the seat 2 can be rotated until it reaches a desired inclination. Once the seat 2 is arranged at the desired inclination, the latches 33 can engage with another set of the locking openings 34 to lock the seat 2 in place.

Referring to FIGS. 1, 2, 12 and 13, the switch 5 can be pivotally assembled with the backrest 23. In one embodiment, the switch 5 can include a shaft portion that is assembled through an elongated slot 311 of the handle 31 and has a radial arm 51 (as better shown in FIGS. 12 and 13), and a rotary knob affixed with the shaft portion. The elongated slot 311 can extend parallel to a lengthwise axis of the backrest 23. The switch 5 can rotate relative to the seat 2 between a first position (as better shown in FIG. 12) allowing the handle 31 to be operated to lock and unlock the recline adjusting mechanism 3, and a second position (as better shown in FIG. 13) where the switch 5 continuously holds the recline adjusting mechanism 3 in the unlocking state.

Figure 12:
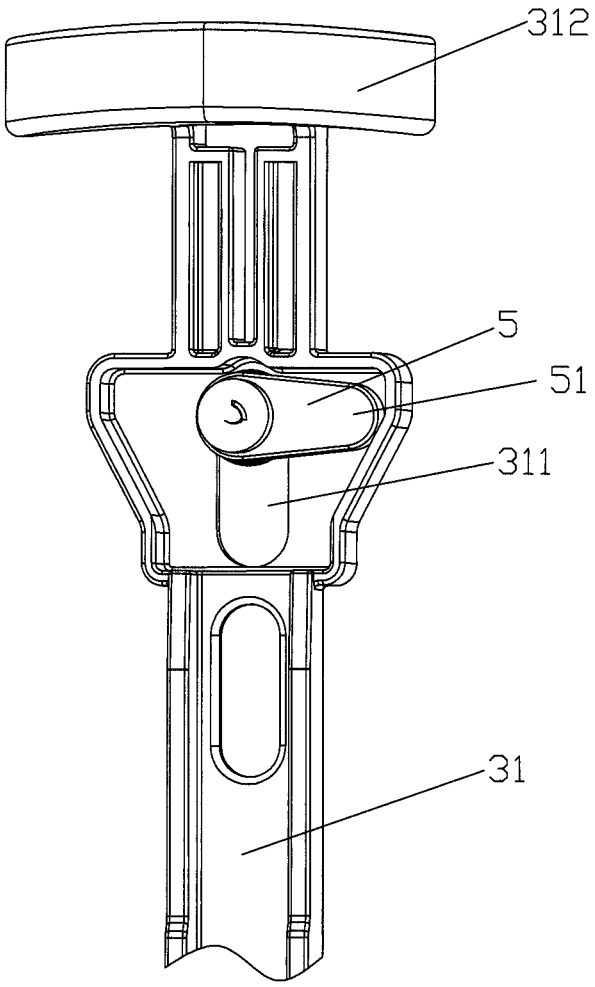
FIG. 12 is a schematic view illustrating a switch of the infant chair apparatus in a swing disabling state.

Referring to FIG. 12, when the switch 5 is in the first position, the radial arm 51 can extend substantially horizontal so that the handle 31 is allowed to move to a lower position for locking the recline adjusting mechanism 3. This corresponds to a swing disabling state in which the recline adjusting mechanism 3 can lock the seat 2 in place and can unlock to permit adjustment of the inclination of the seat 2. In the swing disabling state, the infant chair apparatus can be typically used as a stationary high chair.

Figure 13:
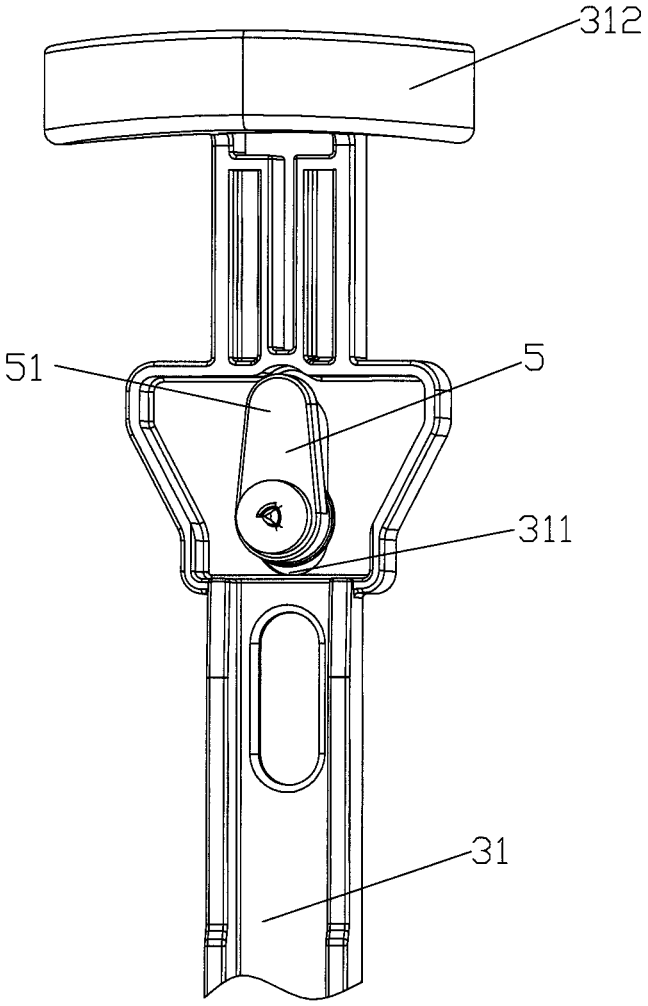
FIG. 13 is a schematic view illustrating the switch of the infant chair apparatus in a swing enabling state.

Referring to FIG. 13, when the switch 5 is in the second position, the radial arm 51 can turn to a substantially vertical position, and push and hold the handle 31 to an upper position. The recline adjusting mechanism 3 thereby can be continuously held in the unlocking state. This corresponds to a swing enabling state in which the seat 2 is not locked with the support frame 1, and locking movement of the recline adjusting mechanism 3 is blocked by the radial arm 51 of the switch 5. In this configuration, the seat 2 can be driven by the swing drive assembly 4 to freely swing relative to the support frame 1 about the axis defined by the pivot shafts 6.

Figure 2:
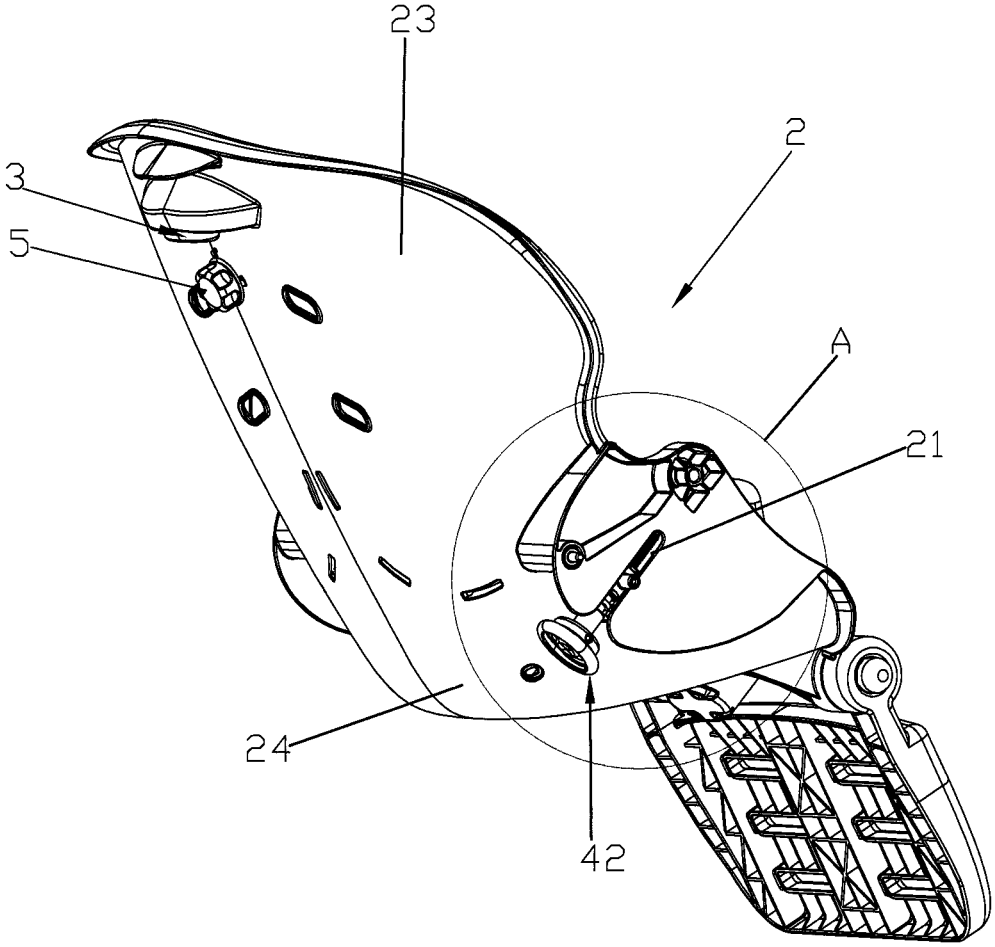
FIG. 2 is a schematic view illustrating a seat part of the infant chair apparatus.

Referring to FIGS. 1 and 2, the seat 2 can include a backrest 23, a seating portion 24 connected with a lower end of the backrest 23, and a coupling member 421 arranged at a lateral side portion of the seat 2. The seat 2 can be assembled with the support frame 1 at a position between the housings 11. The coupling member 421 can receive the application of a driving torque by the swing drive assembly 4 to impart a swing motion to the seat 2.

Referring to FIGS. 1-9, The swing drive assembly 4 can include a spring 41, and a torque adjusting mechanism 42 respectively connected with the spring 41 and the coupling member 421.

Figure 6:
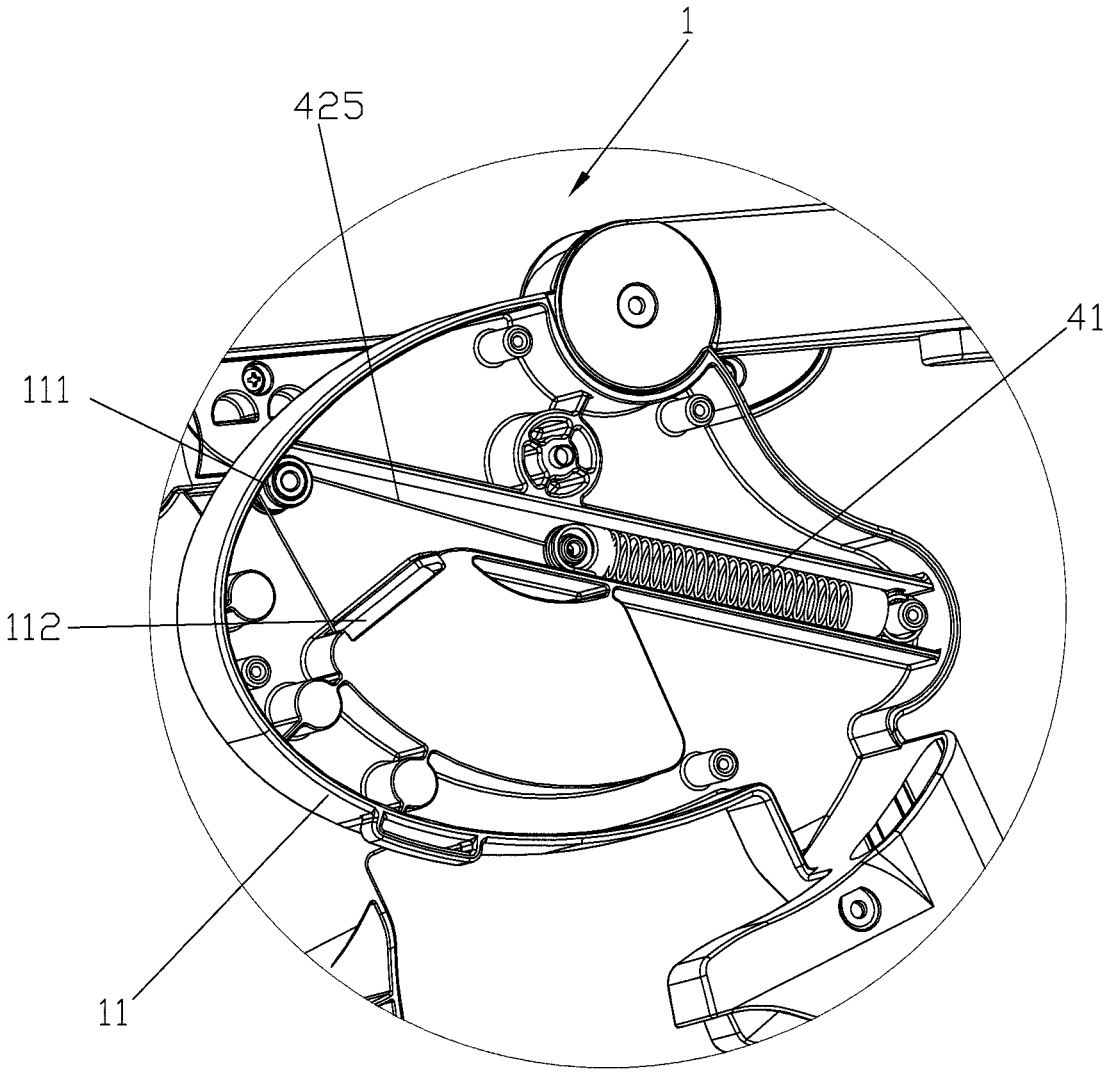
FIG. 6 is a schematic view illustrating a portion of a swing drive assembly provided in the housing shown in FIG. 5.

As better shown in FIGS. 4 and 6, the spring 41 can have a first end affixed with the housing 11, and a movable second end connected with the torque adjusting mechanism 42. The spring 41 can exert a biasing force that is converted through the torque adjusting mechanism 42 into a driving torque which is applied on the coupling member 421 for imparting a swing motion to the seat 2.

The torque adjusting mechanism 42 can be operable to modify the position of the coupling member 421 where the driving torque is applied on the seat 2. More specifically, the torque adjusting mechanism 42 can be operable to adjust an initial length of the spring 41 so as to modify an initial spring force, and/or to change the position of the coupling member 421 on the seat 2. The ability to adjust the position of the coupling member 421 on the seat 2 allows to change the lever arm of the driving torque applied on the seat 2, which can set a desired range of swing amplitude. In one embodiment, the torque adjusting mechanism 42 and the spring 41 may be arranged at one side of the seat 2. In other embodiments, a set of the same torque adjusting mechanism 42 and the spring 41 may be arranged at each of the left and right sides of the seating portion 24.

Referring to FIGS. 3, 4, 7 and 8, the torque adjusting mechanism 42 can include a driving member 422 and a flexible transmission member 425. A side portion of the seat 2 can include a linear elongated slot 21. The driving member 422 can be a screw thread that is pivotally connected with the seat 2, and extends adjacently along the slot 21. An end of the driving member 422 can be affixed with a rotary knob 423 that is outwardly accessible for facilitating manual operation. The coupling member 421 can have a protrusion 421*a* that projects outside the slot 21, and a threaded hole through which the driving member 422 is engaged. Accordingly, a rotation of the driving member 422 can drive a displacement of the coupling member 421 along the slot 21.

Figure 9:
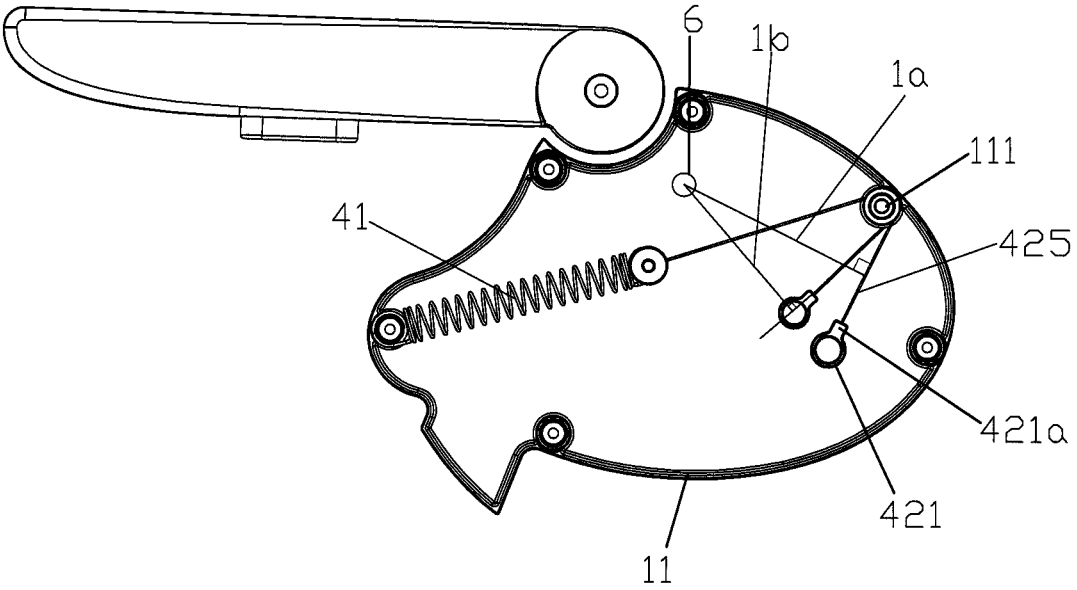
FIG. 9 is a schematic view illustrating exemplary operation of the torque adjusting mechanism.
Figure 10:
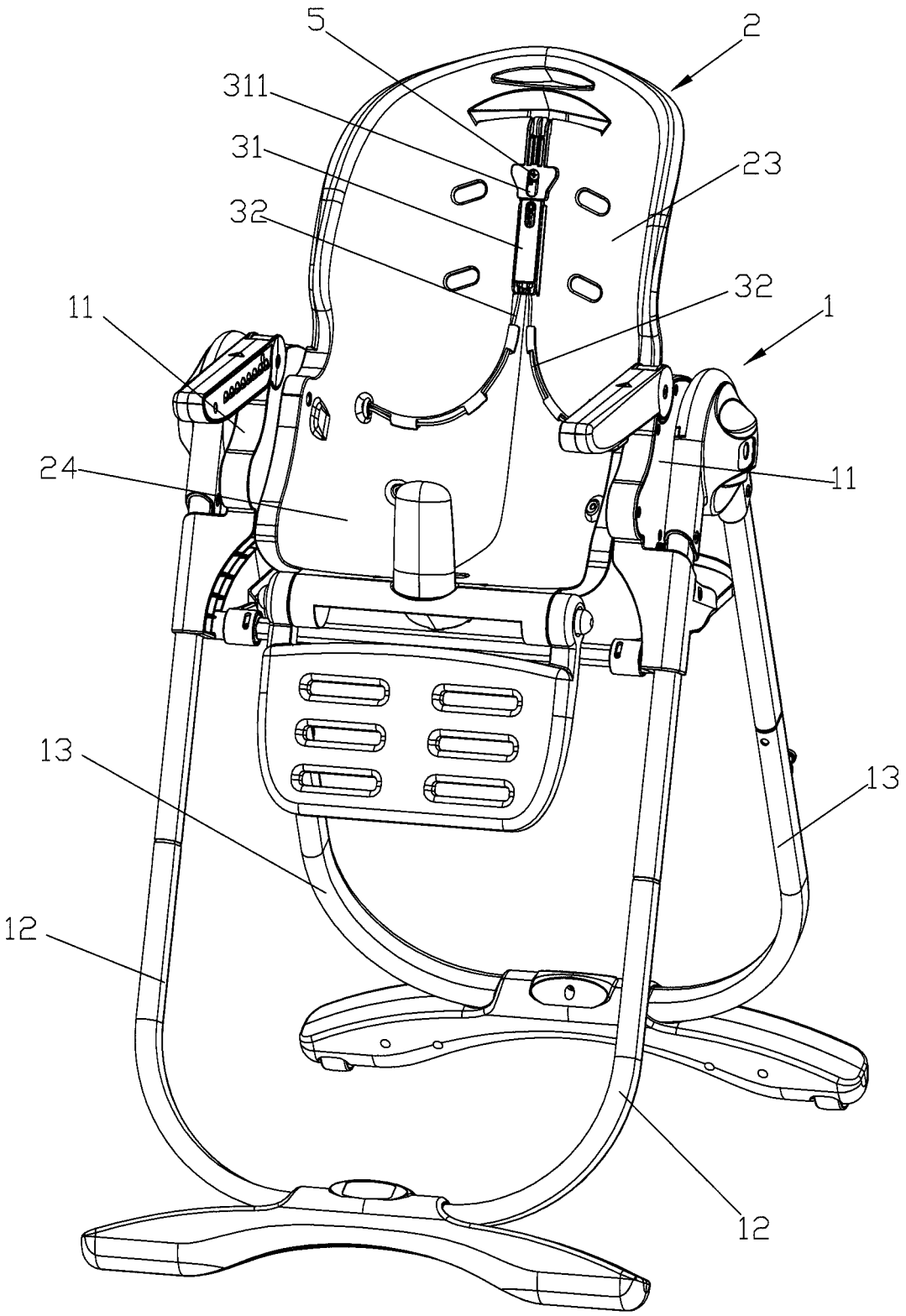
FIG. 10 is a schematic view illustrating the infant chair apparatus of FIG. 1 under another perspective.
Figure 11:
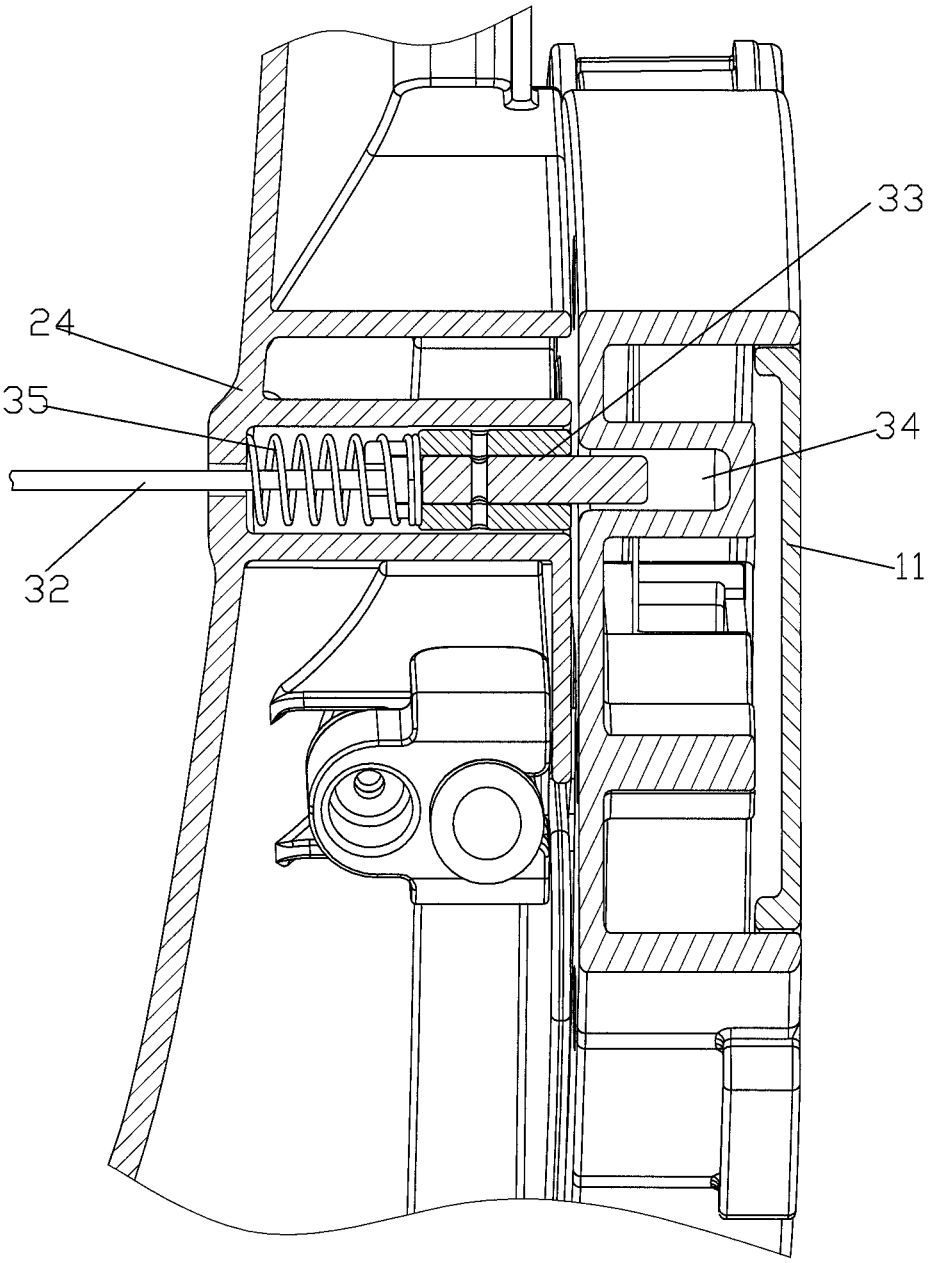
FIG. 11 is a cross-sectional view illustrating a portion of a recline adjusting mechanism provided in the infant chair apparatus.

As better shown in FIGS. 4, 6 and 9, the housing 11 of the support frame 1 that is adjacent to the torque adjusting mechanism 42 can include a pulley 111, and an opening 112 for passage of the transmission member 425. The transmission member 425 can be a cable, a cord, a wire, a strip, a tape, or the like. The transmission member 425 can be connected with the movable end of the spring 41 at one first end, wrap around the pulley 111, travel through the opening 112, and connect with the protrusion 421*a* of the coupling member 421 at one second end. This routing can define a first segment of the transmission member 425 that extends linear between the spring 41 and the pulley 111, and a second segment of the transmission member 425 that extends linear between the pulley 111 and the coupling member 421 and intersects the first segment at an angle. The slot 21 can extend along a direction that intersects the second segment of the transmission member 425 at an angle.

When the driving member 422 drives the coupling member 421 to move along the slot 21, the second end of the transmission member 425 and the coupling member 421 can move in unison along the slot 21.

Figure 7:
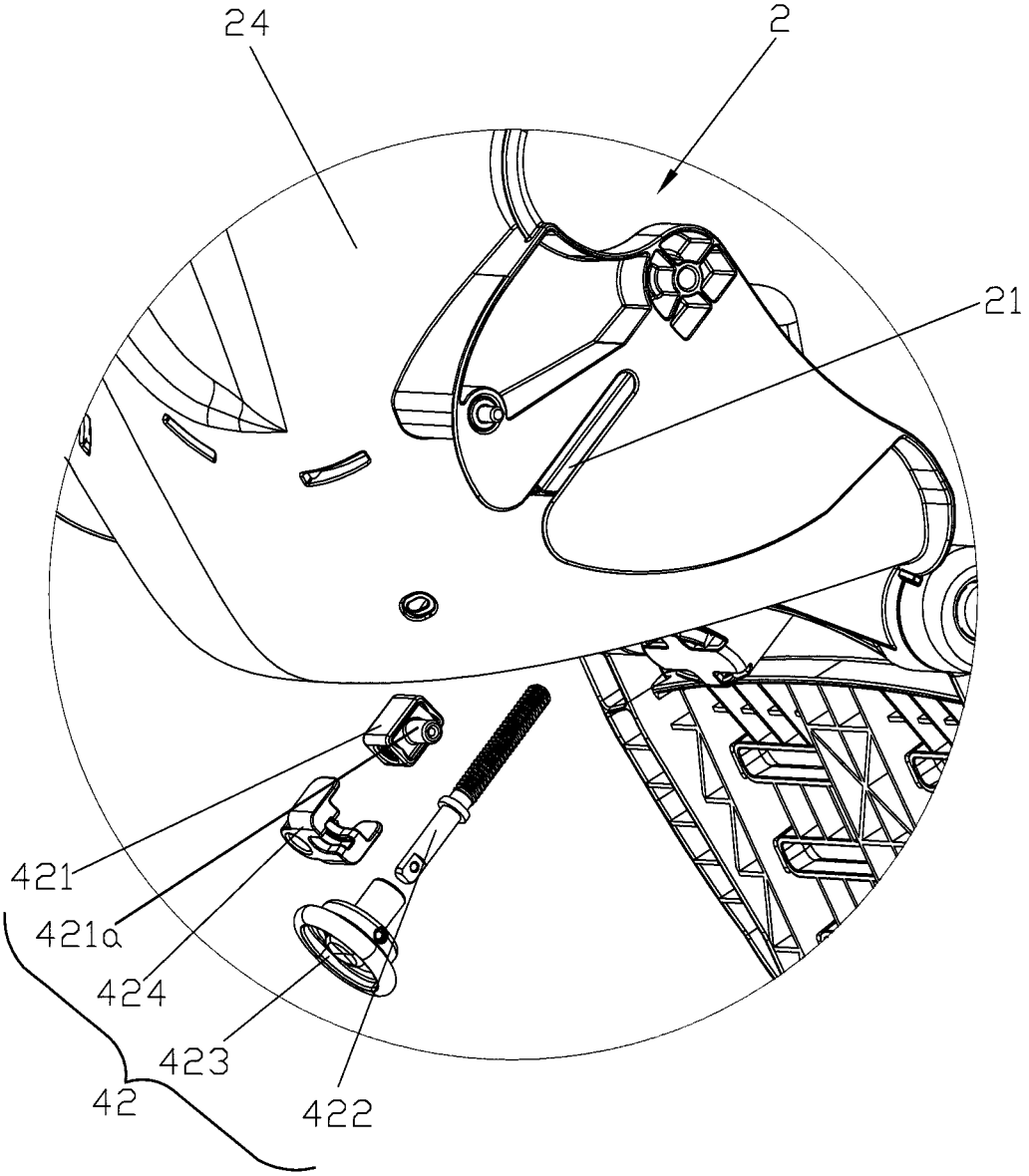
FIG. 7 is an exploded view of the torque adjusting mechanism shown in FIG. 3.
Figure 8:
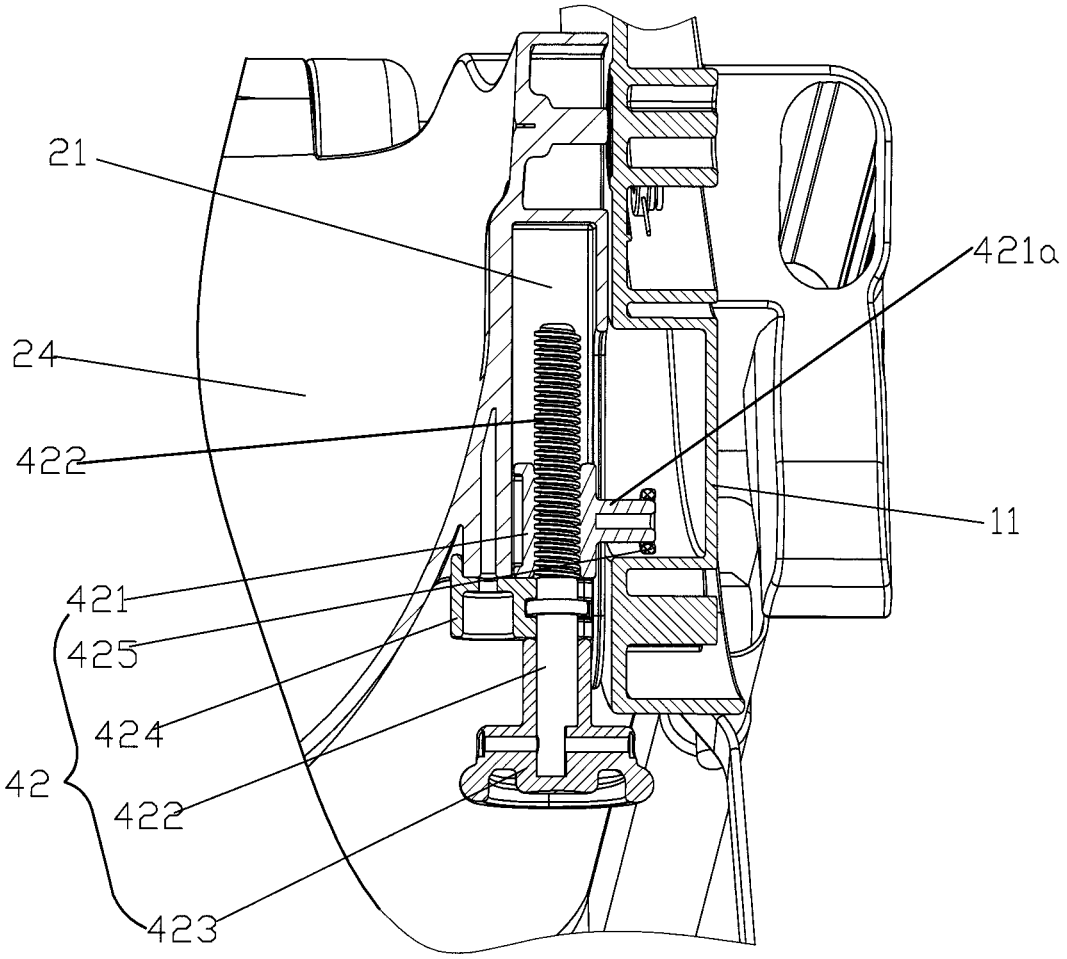
FIG. 8 is a cross-sectional view illustrating the torque adjusting mechanism shown in FIG. 3.

Referring to FIG. 7, the torque adjusting mechanism 42 can further include a stop member 424 adapted to limit an axial displacement of the coupling member 421 along the slot 21. The stop member 424 may be affixed with the seat 2, and include a hole through which the driving member 422 can be assembled.

When the rotary knob 423 is operated to rotate the driving member 422, the coupling member 421 can slide upward or downward along the slot 21, which modifies the angle between the first and second segments of the transmission member 425. The housing 42 can also include a slot 113 through which the protrusion 421 a of the coupling member 421 can project to connect with the transmission member 425. The slot 113 can have a fan or curved shape that can delimit a maximum range of amplitude in the swing travel of the seat 2.

Figure 3:
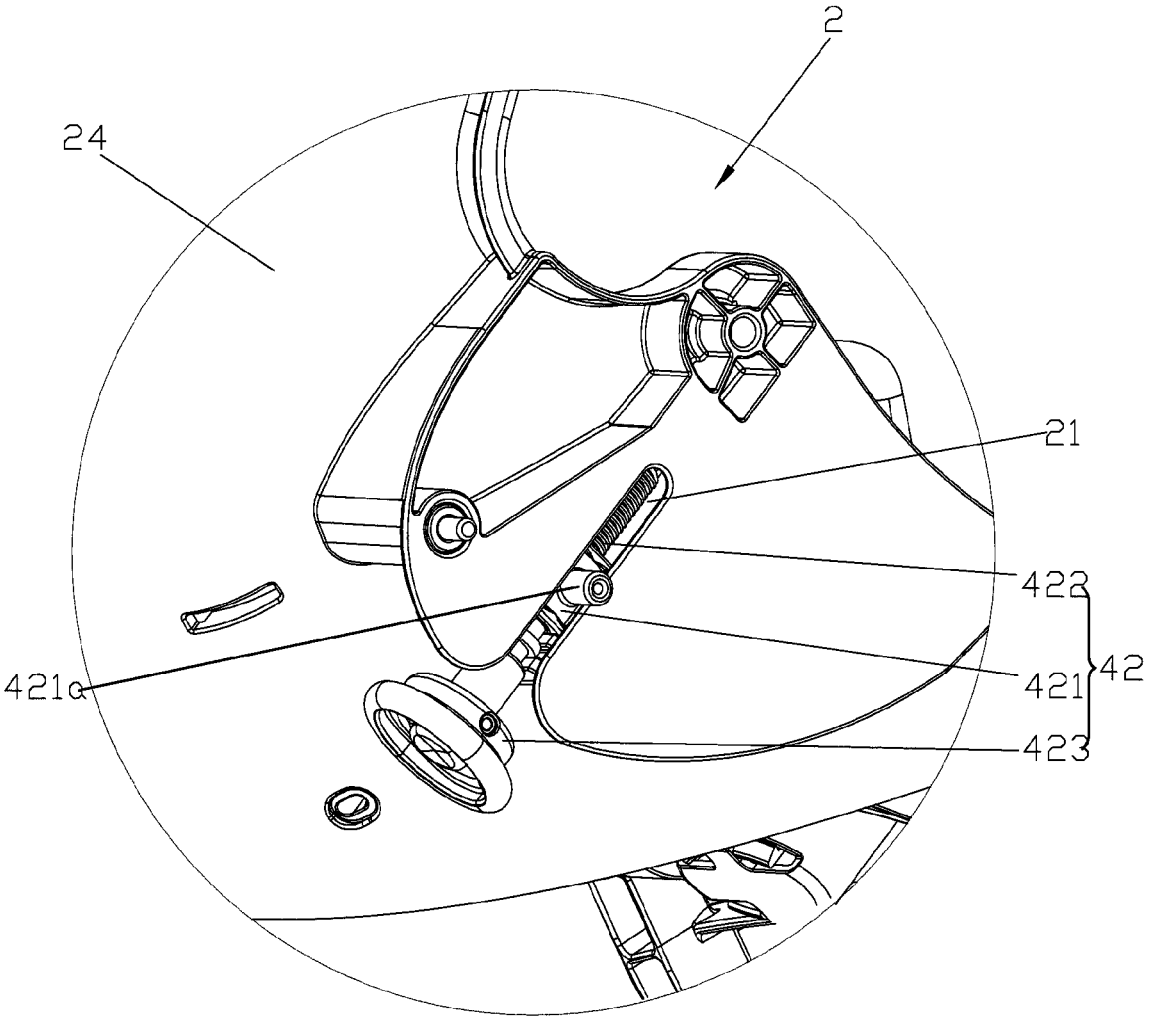
FIG. 3 is an enlarged view of portion A shown in FIG. 2 illustrating a torque adjusting mechanism provided on the seat.
Figure 4:
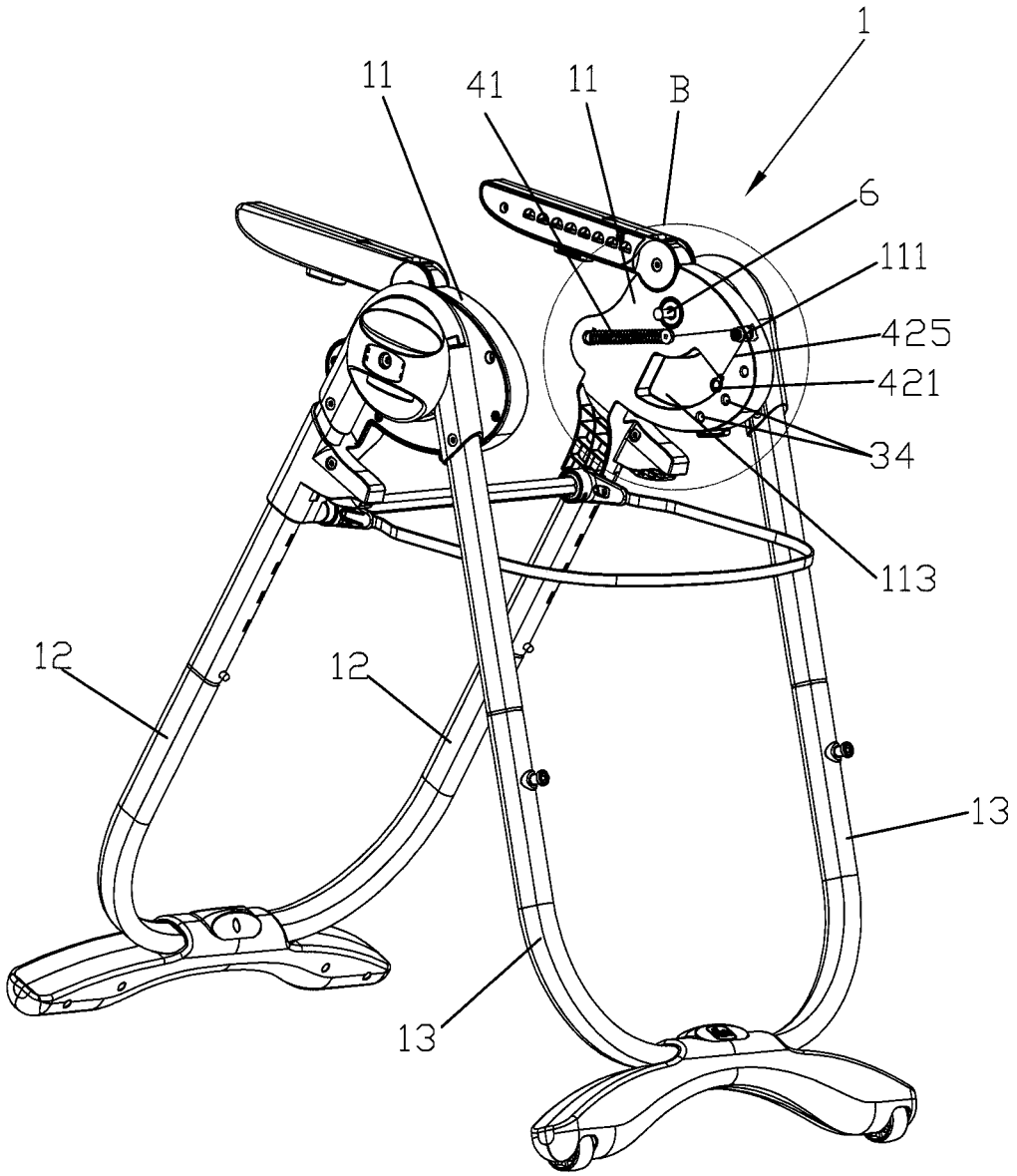
FIG. 4 is a schematic view illustrating a support frame of the infant chair apparatus shown in FIG. 1 without the seat.
Figure 5:
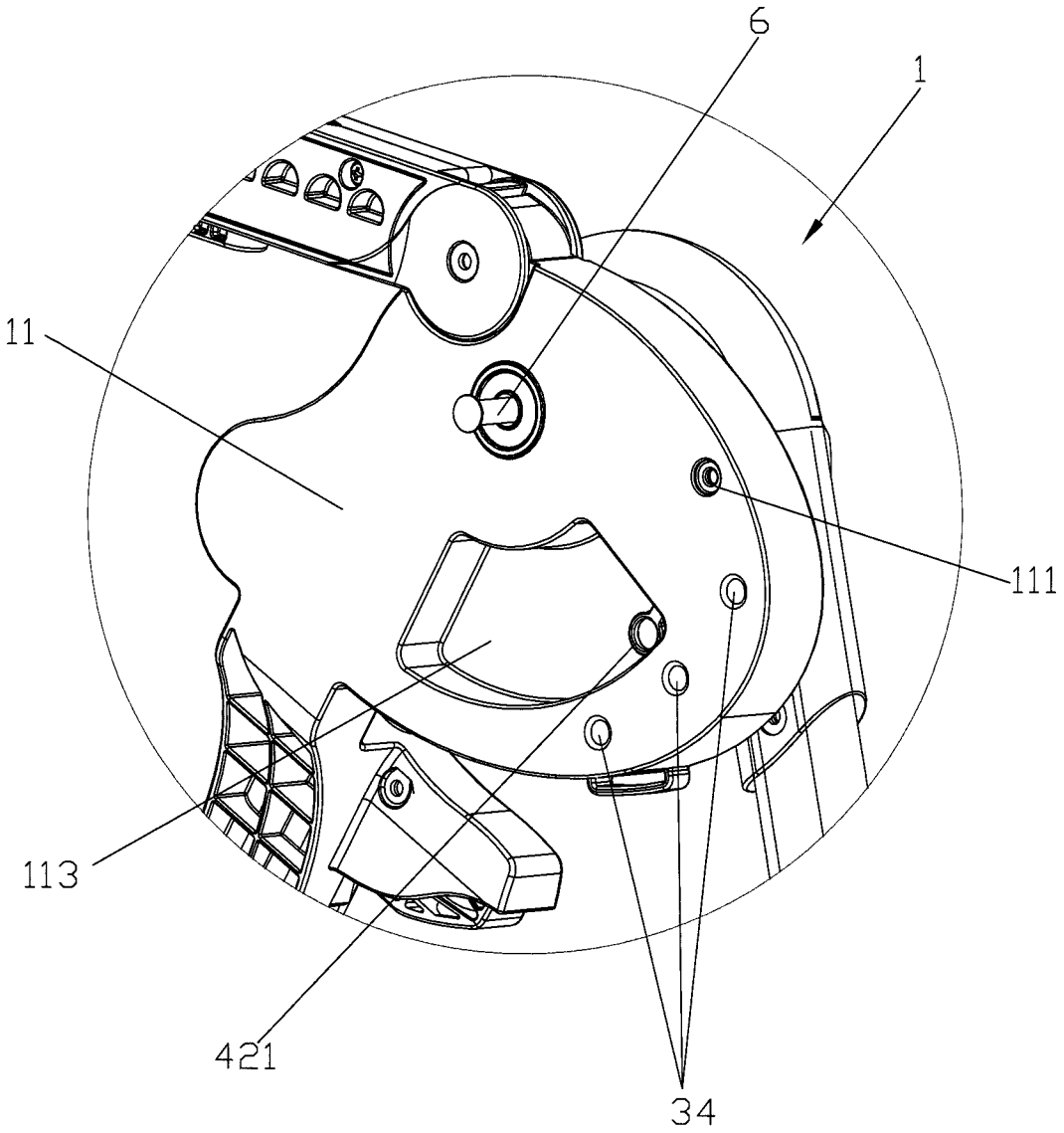
FIG. 5 is an enlarged view of portion B shown in FIG. 4.

Referring to FIGS. 3 and 9, the force exerted by the spring 41 can be transmitted along the transmission member 425 and converted into a driving torque applied at the coupling member 421 on the seat 2. The lever arm of the driving torque can be defined as the distance between the pivot axis of the pivot shafts 6 and the second segment of the transmission member 425 extending between the pulley 111 and the coupling member 421.

When the coupling member 421 moves relative to the seat 2 along the slot 21, the transmission member 425 attached thereto can draw a slight displacement of the spring 41 that modifies its length. The displacement of the coupling member 421 relative to the seat 2 can also modify the direction along which the second segment of the transmission member 425 extends, which changes the lever arm of the driving torque applied at the coupling member 421. As a result, the range of the driving torque applied on the seat 2 can be adjusted. Referring to the example shown in FIG. 9, a greater torque 1*a* can be adapted to drive a swing motion for a child of a higher weight, whereas a smaller torque 1*b* can be sufficient to drive a swing motion for a child of a smaller weight. With the torque adjusting mechanism 42, a suitable torque can be accordingly applied in accordance with the weight of the child to provide a smooth and comfortable swing motion. Problems such as excessive swing amplitudes when the child is lighter in weight, or insufficient swing amplitudes owing to a heavier child can be thereby overcome.

In alternate embodiments, the slot 21 may be modified to have a curved shape so that movement of the coupling member 421 along the slot 21 would not result in a change in the length of the spring 41.

Figure 14:
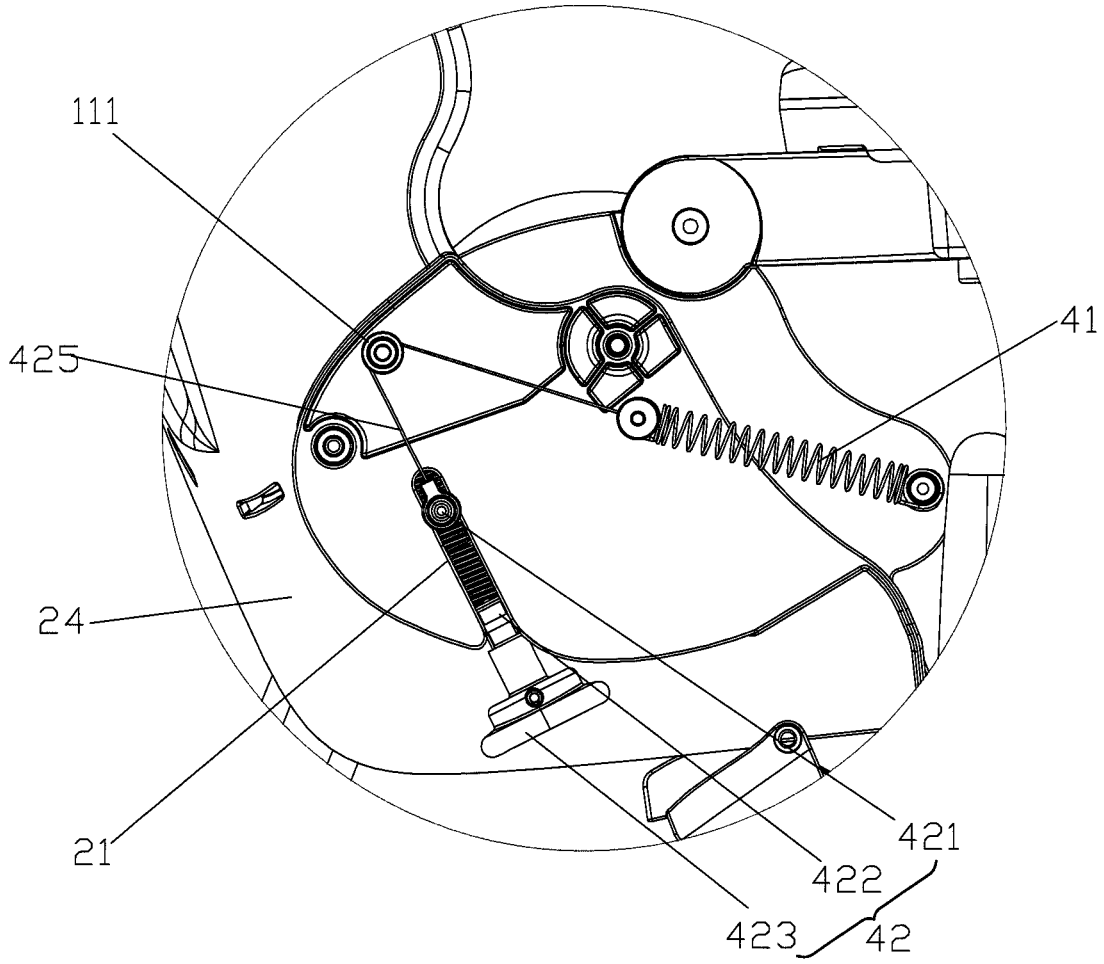
FIG. 14 is a schematic view illustrating a variant embodiment of the torque adjusting mechanism.
Figure 15:
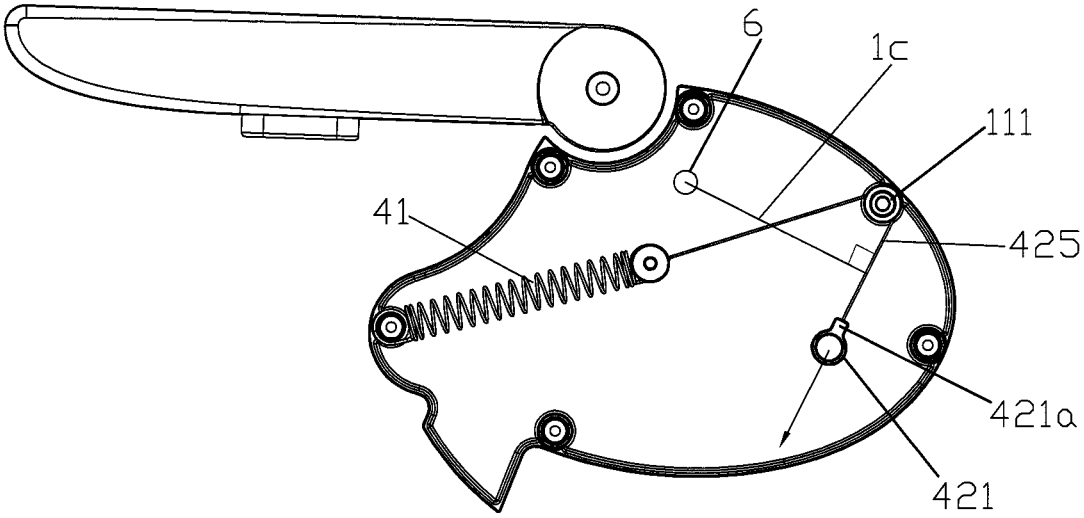
FIG. 15 is a schematic view illustrating exemplary operation of the torque adjusting mechanism shown in FIG. 14.
Figure 16:
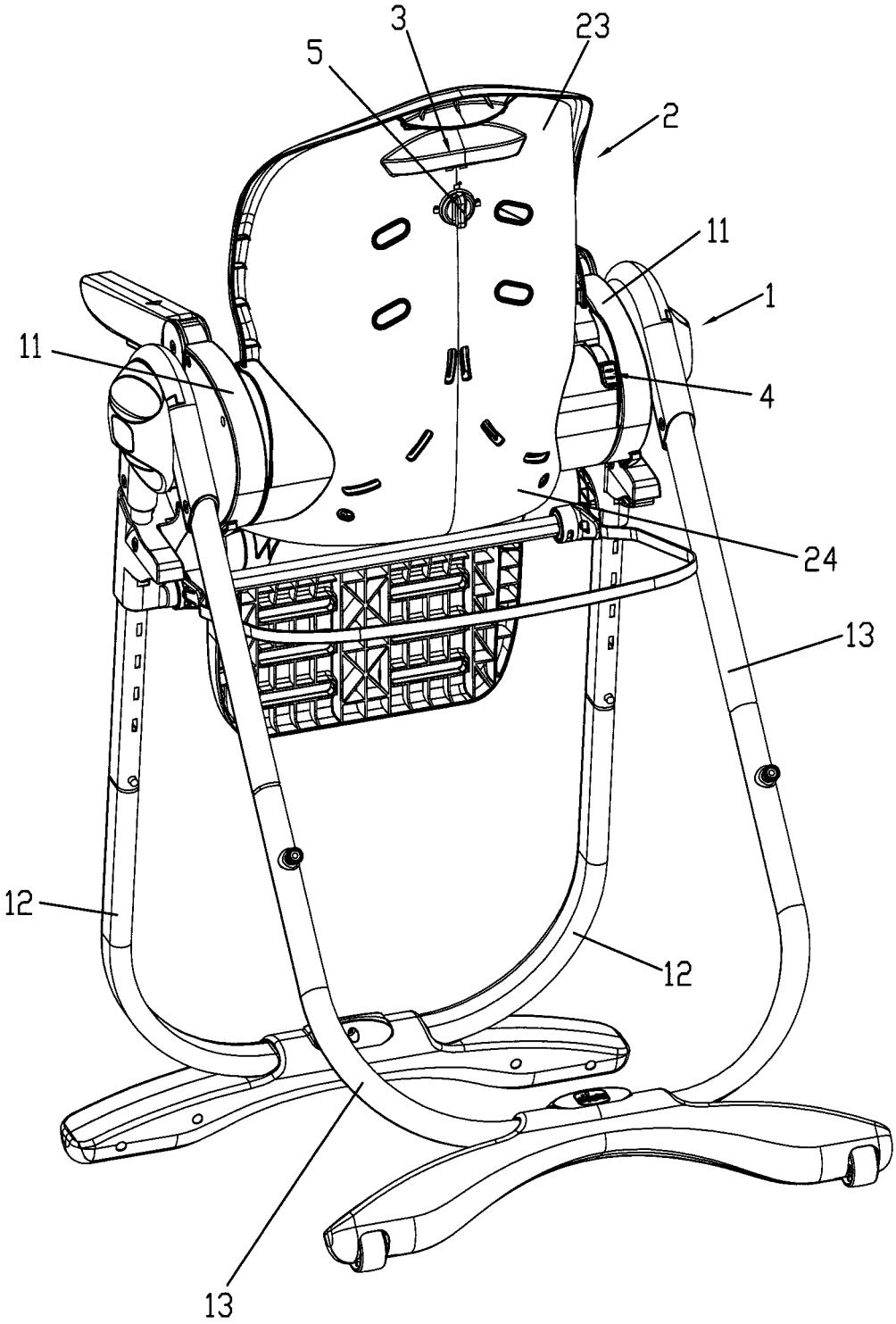
FIG. 16 is a schematic view illustrating another embodiment of an infant chair apparatus.
Figure 17:
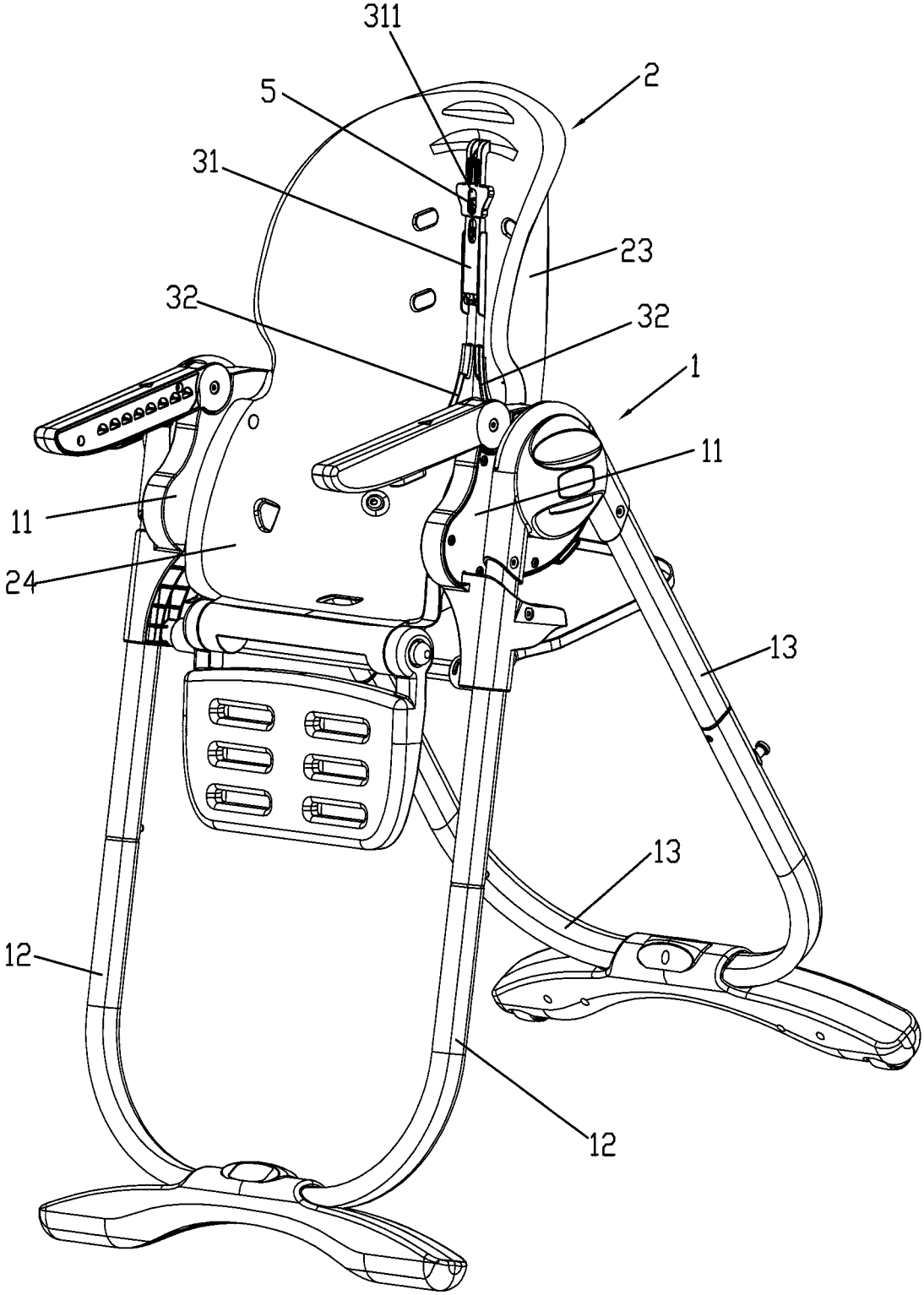
FIG. 17 is a schematic view illustrating the infant chair apparatus of FIG. 16 under another perspective.
Figure 18:
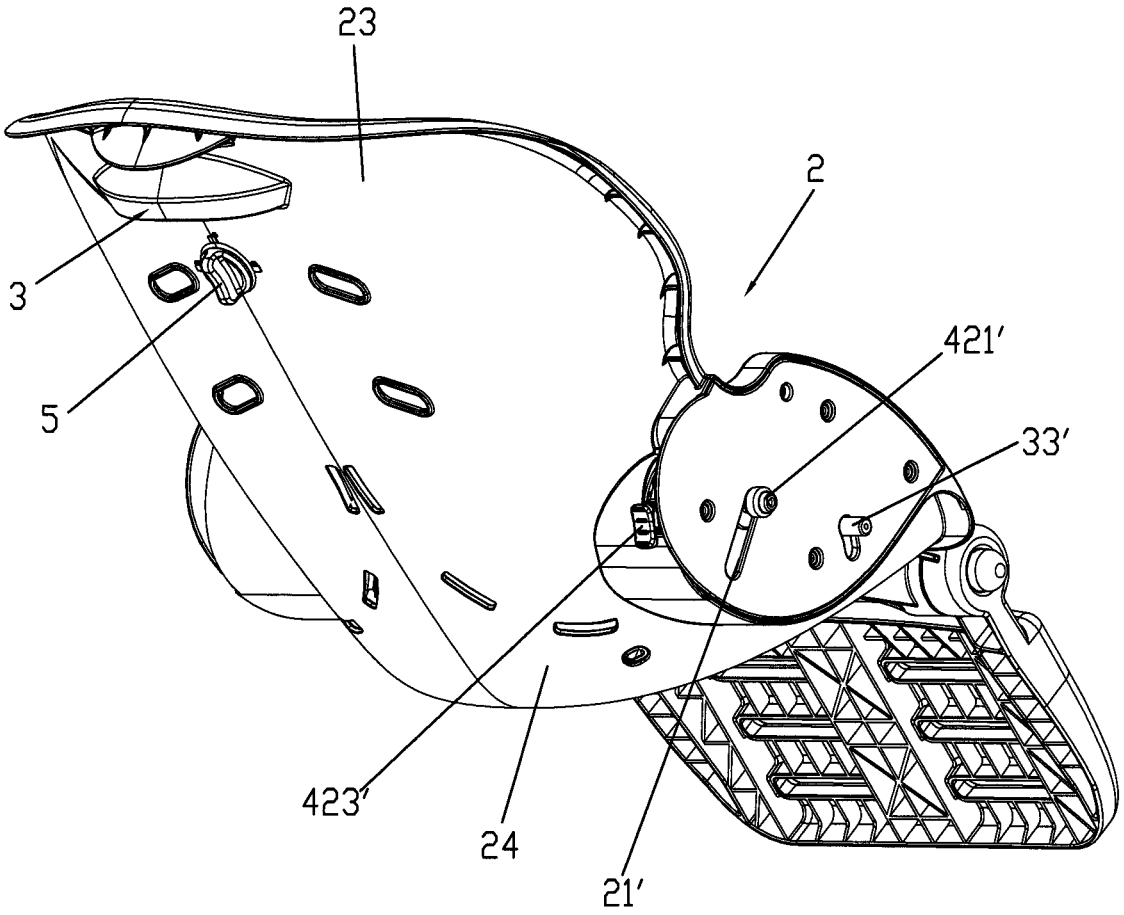
FIG. 18 is schematic view illustrating a seat part of the infant chair apparatus shown in FIG. 16.

FIGS. 14 and 15 are schematic views illustrating a variant embodiment of the torque adjusting mechanism 42 shown previously. One difference of the torque adjusting mechanism 42 shown in FIGS. 14 and 15 includes the configuration of the slot 21, which can linearly extend along the same direction as the second segment of the transmission member 425 extending between the pulley 111 and the coupling member 421. The lever arm of the torque applied at the coupling member 421 can be defined as the distance between the axis of the pivot shafts 6 and the second segment of the transmission member 425 extending between the pulley 111 and the coupling member 421. The other component parts and connections can be similar to the embodiment described previously.

Referring to FIG. 15, a controlled displacement of the coupling member 421 along the slot 21 can cause the spring 41 to deform, which results in a change in the applied spring force. While the coupling member 421 moves along the slot 21, the lever arm 1*c* of the driving torque can remain constant. As a result, the torque applied at the coupling member 421 on the seat 2 can be desirably adjusted.

FIGS. 16-22 are schematic views illustrating another variant embodiment of the infant chair apparatus. This embodiment can be partially similar to the embodiments described previously. The recline adjusting mechanism 3 can include the handle 31, the two transmission members 32 and two latches 33'. Each of the two housings 11 can include a plurality of locking openings 34' for engagement of one adjacent latch 33', and a curved slot 36 that connects with the locking openings 34'. The latches 33' can be respectively guided in movement along the slots 36, and can respectively engage with any of the locking openings 34' to lock the seat 2 at a desired inclination.

The handle 31 can be assembled with the backrest of the seat 2. Each transmission member 32 can have a first end connected with the handle 31, and a second end connected with one latch 33' associated therewith. The two latches 33' can be pivotally assembled at the left and right sides of the seat 2, and can respectively engage with any of a plurality of locking openings 34' formed through the housings 11. A spring 35' assembled with each latch 33' can be operable to bias the latch 33' to engage with any of the locking openings 34'.

When it is operated, the handle 31 can pull the transmission members 32 upward, which drives the latches 33' to respectively disengage from the locking openings 34' and enter the slots 36. As the seat 2 is pivoted to modify its inclination, the latches 33' can respectively slide along the slots 36. Once the seat 2 is at the desired inclination, the handle 31 can be released, and the latches 33' biased by the springs 35' can engage with a corresponding set of the locking openings 34' to lock the seat 2 in place.

Referring to FIGS. 18-20 and 22, the seat 2 can include a coupling member 421' where a driving torque can be applied to impart a swing motion to the seat 2. More specifically, a side portion of the seat 2 can have a guide slot 21' through which the coupling member 421' can be movably assembled with the seat 2.

The torque adjusting mechanism 42 can be operable to modify the position of the coupling member 421' along the guide slot 21'. The torque adjusting mechanism 42 can include the flexible transmission member 425 and a driving member 422' provided as a rotary part. The transmission member 425 can have a first end connected with the movable end of the spring 41, and a second end connected with the coupling member 421'. The driving member 422' can have a central shaft pivotally connected with the seat 2, a first end connected with the coupling member 421', and a second end opposite to the first end that is movably connected with an actuator button 423'.

The actuator button 423' is movable radially relative to the rotation axis of the driving member 422'. Moreover, the actuator button 423' can have an engaging protrusion 423'a that can engage with any of a plurality of grooves 22' provided on the side portion of the seat 2 at different radial positions relative to the rotation axis of the driving member 422'. A spring 424' can be assembled between the actuator button 423' and the rotary member 422'. The spring 424' can bias the actuator button 423' for urging the engaging protrusion 423'a to engage with any of the grooves 22'. When the actuator button 423' is depressed, the engaging protrusion 423'a can disengage from any of the grooves 22'. The driving member 422' then can rotate to drive displacement of the coupling member 421' along the slot 21', which in turn pulls on the transmission member 425 to modify the direction along which the second segment of the transmission member 425 extends between the pulley 111 and the coupling member 421'. Once the coupling member 421' reaches the desired position, the engaging protrusion 423'a can engage with one of the grooves 22' to lock the actuator button 423' in place. The driving member 422' and the coupling member 421' can be thereby rotationally locked.

Figure 19:
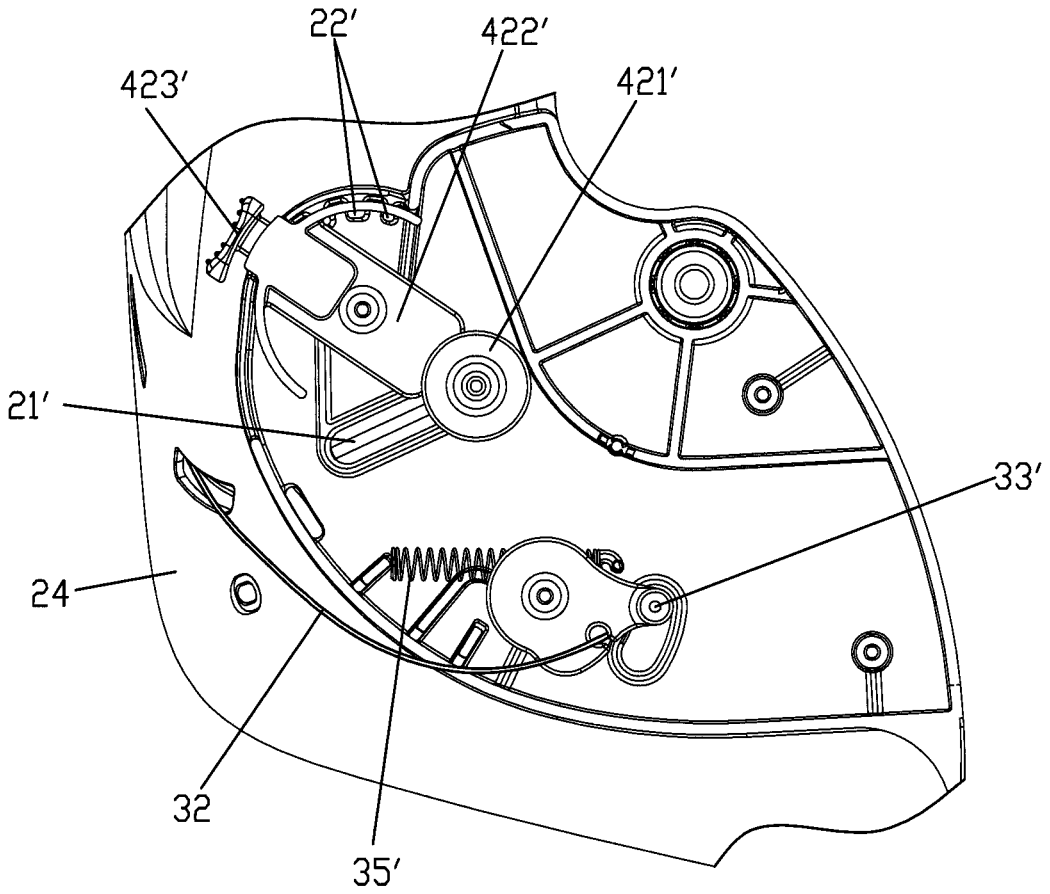
FIG. 19 is a schematic view illustrating a torque adjusting mechanism provided in the seat of the infant chair apparatus shown in FIG. 16.
Figure 20:
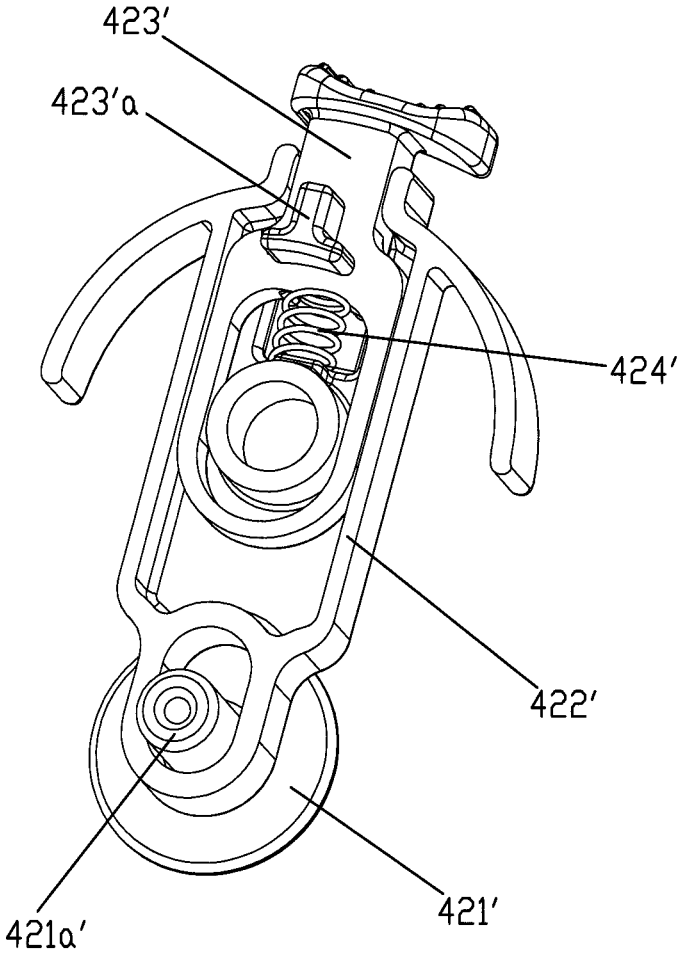
FIG. 20 is a schematic view illustrating the assembly of the torque adjusting mechanism shown in FIG. 19.
Figure 21:
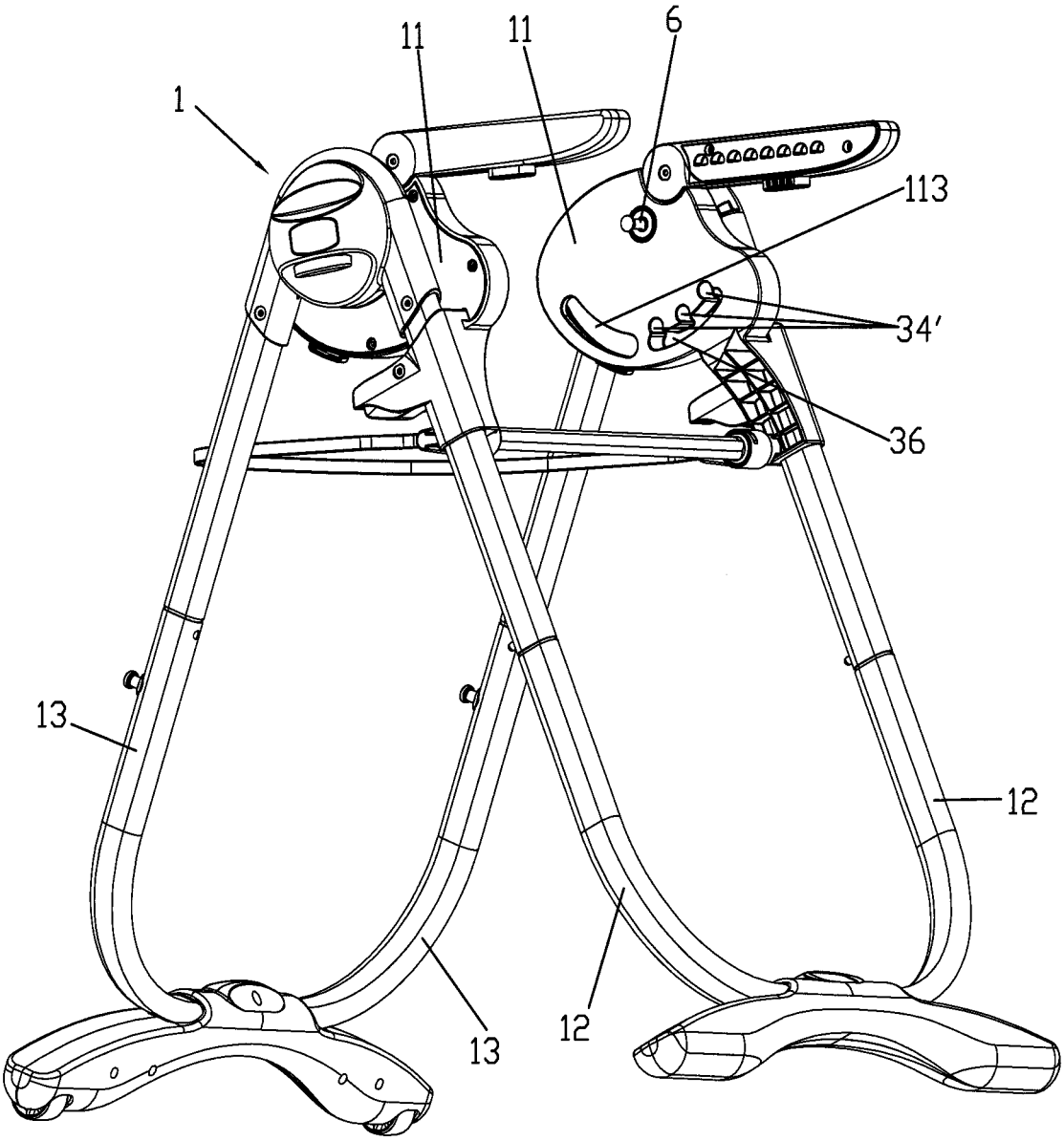
FIG. 21 is a schematic view illustrating a support frame of the infant chair apparatus shown in FIG. 16 without the seat.
Figure 22:
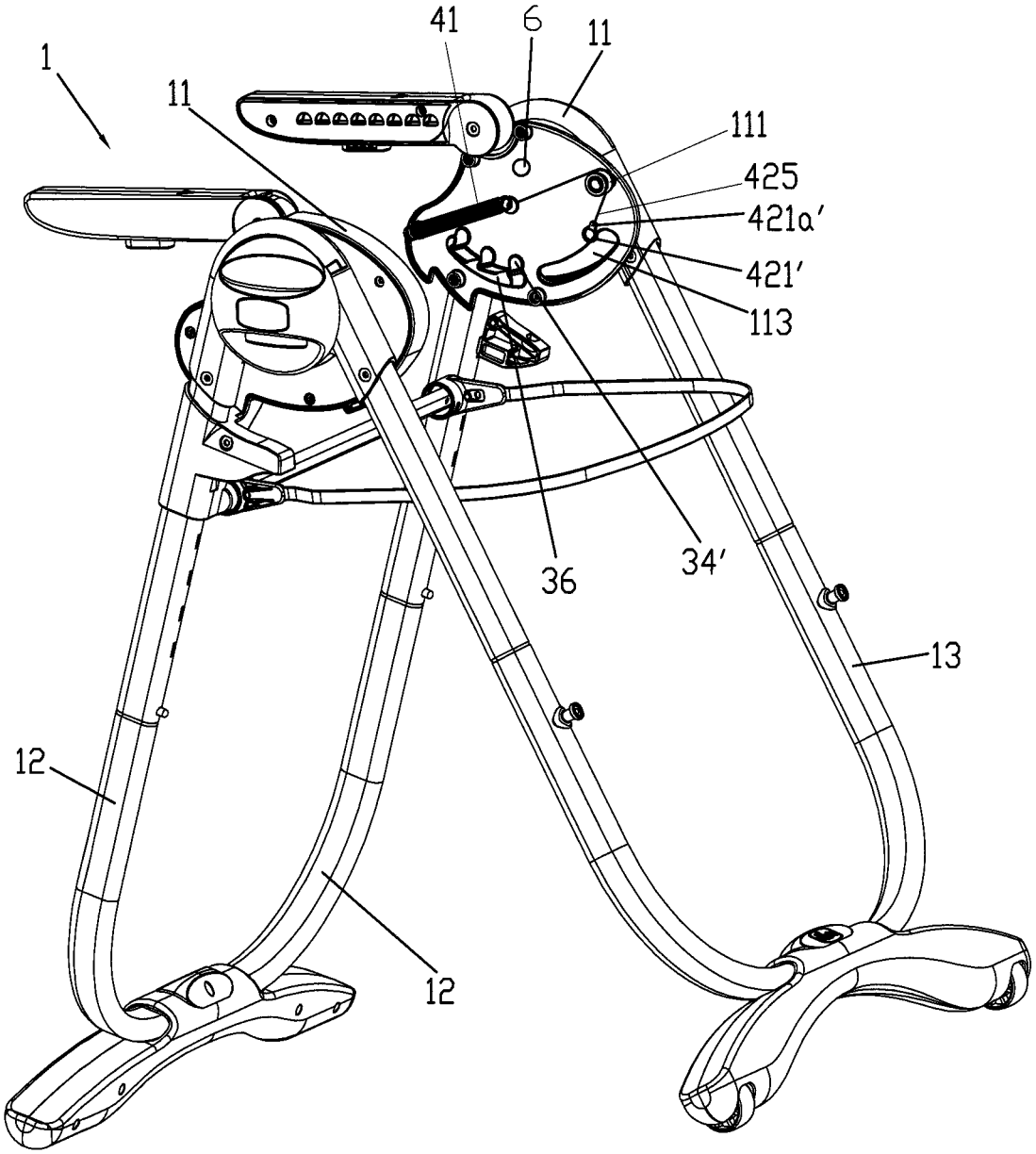
FIG. 22 is a schematic view illustrating a portion of a swing drive assembly in the infant chair apparatus shown in FIG. 16.

As shown in FIGS. 19 and 20, the slot 21' can have a linear shape, and the coupling member 421' can be movably connected with the driving member 422'. When the driving member 422' rotates, a relative displacement between the coupling member 421' and the driving member 422' can occur to facilitate driving of the coupling member 421' along the slot 21'. In other embodiments, the slot 21' can have a curved shape, and the coupling member 421' may be fixedly secured with the driving member 422'.

Figure 23:
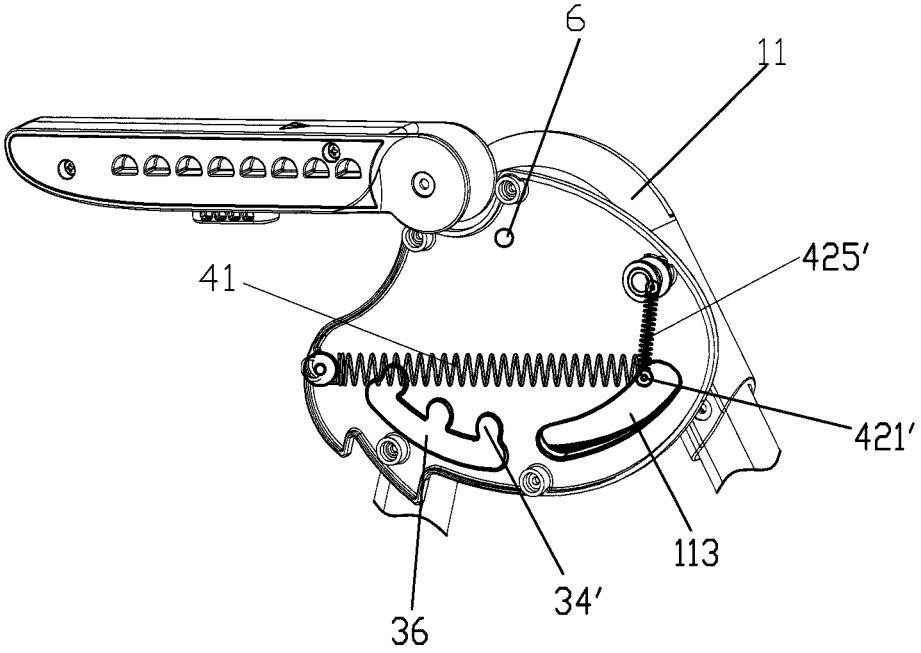
FIG. 23 is a schematic view illustrating a variant embodiment of the torque adjusting mechanism shown in FIG. 19.

FIG. 23 is a schematic view illustrating a variant embodiment of the torque adjusting mechanism shown in FIG. 19. In FIG. 23, the transmission member 425 is replaced with a spring 425' that has a first end connected with the housing 11, and a second end connected with the coupling member 421'. Moreover, the spring 41' can also be commonly connected with the coupling member 421'. Both the springs 41 and 425' can be extension springs. Like previously described, the position of the coupling member 421' relative to the seat 2 can be changed by, for example, operating the driving member 422'. A movement of the coupling member 421' relative to the seat 2 can adjust the spring forces respectively exerted by the springs 41 and 425', and the lever arms of the torques respectively applied by the springs 41 and 425' relative to the pivot axis of the pivot shafts 6. With this construction, the total torque applied by the springs 41 and 425' at the coupling member 421' on the seat 2 can be accordingly adjusted to provide a desired swing motion.

Figure 24:
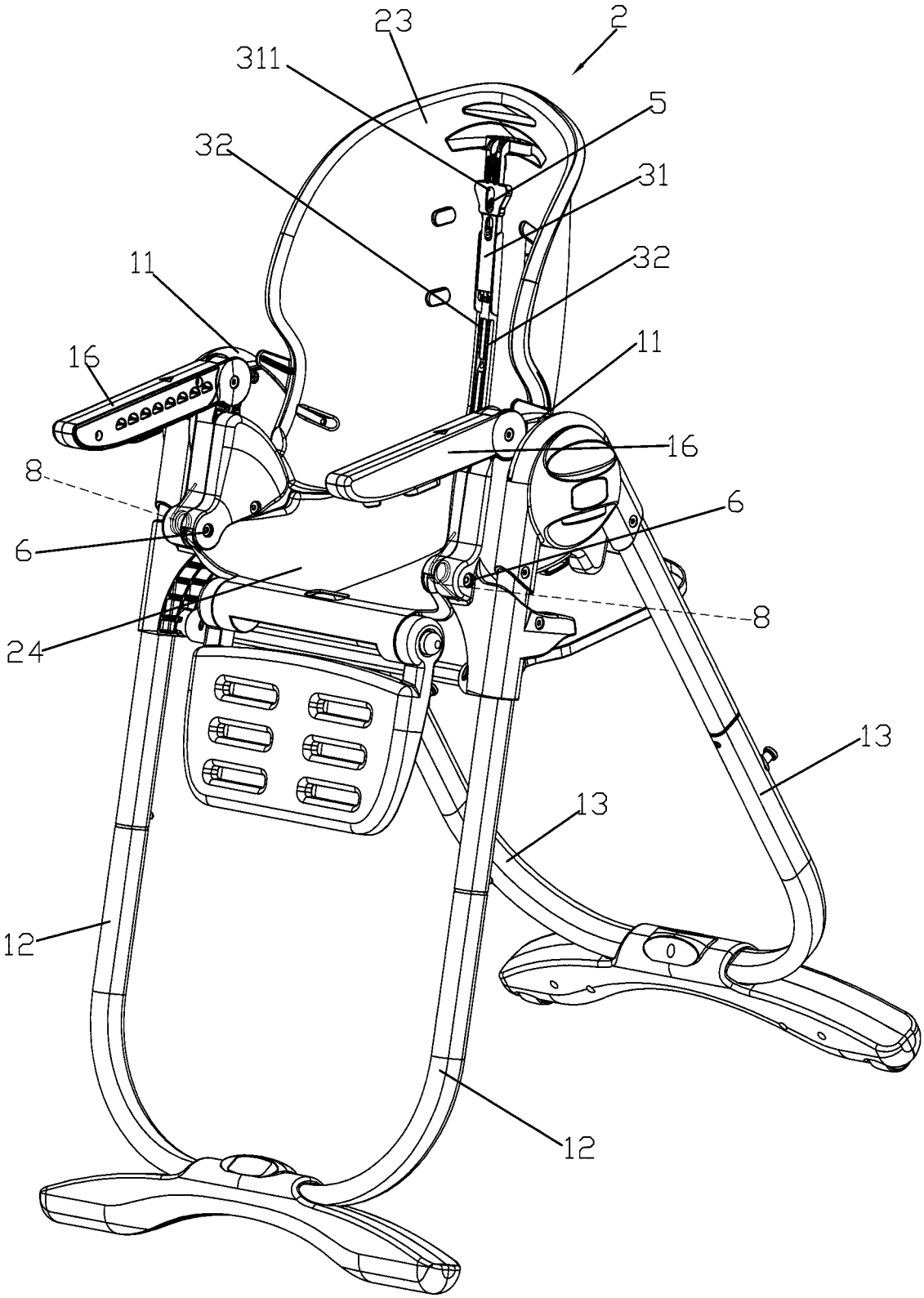
FIG. 24 is a schematic view illustrating another variant embodiment of an infant chair apparatus.
Figure 25:
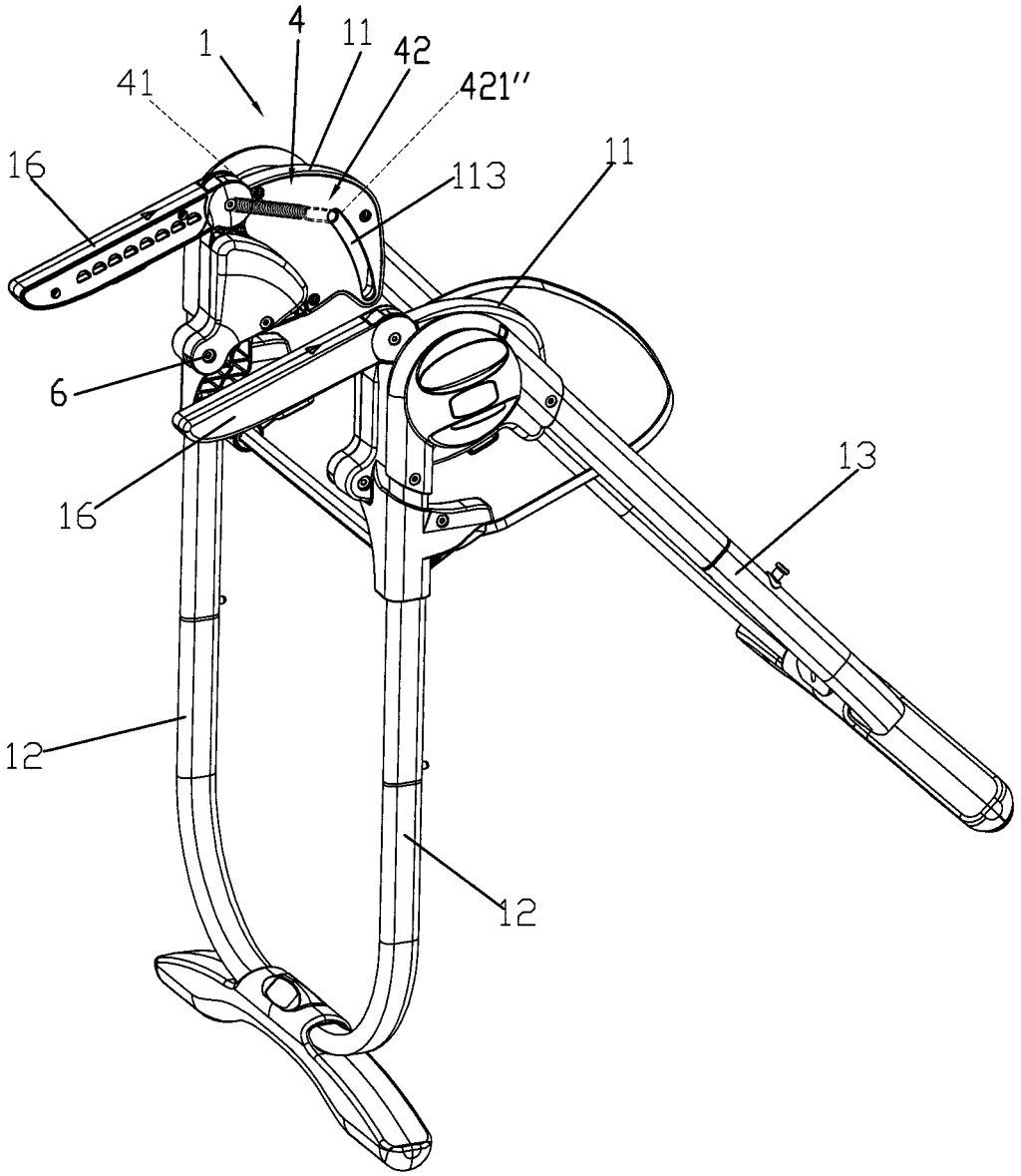
FIG. 25 is a schematic view illustrating the infant chair apparatus shown in FIG. 24 without the seat.
Figure 26:
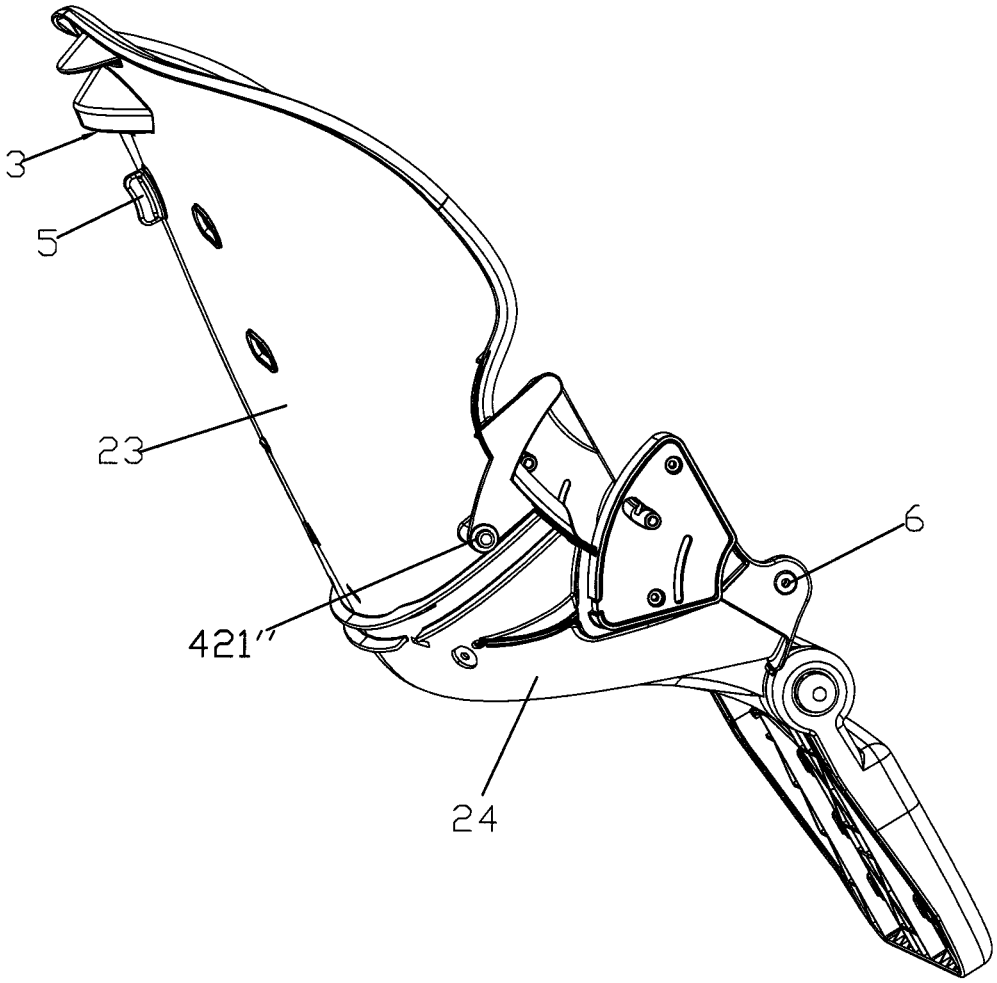
FIG. 26 is a schematic view illustrating the seat of the infant chair apparatus shown in FIG. 24.

FIGS. 24 and 26 are schematic views illustrating another embodiment of the infant chair apparatus. In this embodiment, the swing drive assembly 4 can include an coupling member 421" that is affixed with the seat 2 at a lateral side of the backrest, and can be guided for movement along a slot 113 formed in the housing 11 during the swing travel of the seat 2. The spring 41 can have a first end connected at a pivot point of an armrest 16 on the support frame 1, and a second end connected with the coupling member 421" of the seat 2. The pivot axis of the pivot shafts 6 where the seat 2 is pivotally assembled with the support frame 1 can be located adjacent to a front portion of the seating portion 24. When the seat 2 swings relative to the support frame 1 about the pivot shafts 6, the coupling member 421" can move along the slot 113.

Referring to FIG. 24, the infant chair apparatus can further include cushion springs 8 respectively disposed adjacent to the pivot shafts 6 and connected with the support frame 1 and the seat 2. The cushion springs 8 can prevent the seat 2 from bouncing forward during the swing travel.

Embodiments illustrated herein describe infant chair apparatuses that can include a recline adjusting mechanism operable to set a desired inclination of the seat, and a swing drive assembly operable to impart a swing motion to the seat. The swing drive assembly can include a spring operable to exert a spring force that can be converted into a driving torque applied at a coupling member on the seat, and a torque adjusting mechanism operable to modify a position of the coupling member relative to the seat to adjust the driving torque. Moreover, the infant chair apparatuses can include a switch having a swing disabled state in which the infant chair can be used as a stationary chair, and a swing enabling state in which a swing motion with an adjustable amplitude can be imparted to the seating portion of the chair relative to the support frame. As a result, the infant chair apparatus can be more versatile in use.

Realizations of the infant chair apparatus have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the inventions as defined in the claims that follow.

What is claimed is:

1. An infant chair apparatus comprising:

a support frame;

a seat pivotally connected with the support frame about a pivot axis and provided with a coupling member; and a swing drive assembly connected with the seat and the support frame, wherein the swing drive assembly includes:

a spring having a first end affixed with the support frame and a movable second end operatively connected with the coupling member, wherein the spring is operable to apply a spring force that is converted into a driving torque applied on the coupling member to impart a swing motion to the seat; and a torque adjusting mechanism respectively connected with the second end of the spring and the coupling member, the torque adjusting mechanism being operable to adjust a position of the coupling member relative to the seat.

2. The infant chair apparatus according to claim 1, wherein the torque adjusting mechanism includes a flexible transmission member having a first and a second end, the first end of the transmission member being connected with the second end of the spring, the second end of the transmission member being connected with the coupling member, and a displacement of the coupling member causes a displacement of the second end of the spring and modifies a lever arm of the driving torque relative to the pivot axis.

3. The infant chair apparatus according to claim 2, wherein the torque adjusting mechanism further includes a pulley, and the transmission member wraps around the pulley to define a first segment extending between the second end of the spring and the pulley, and a second segment that extends between the pulley and the coupling member and intersects the first segment at an angle.

4. The infant chair apparatus according to claim 3, wherein the seat has a side portion provided with a guide slot along which the coupling member is movable relative to the seat.

5. The infant chair apparatus according to claim 4, wherein the guide slot intersects the second segment of the transmission member at an angle.

6. The infant chair apparatus according to claim 4, wherein the guide slot extends in a same direction as the second segment of the transmission member.

7. The infant chair apparatus according to claim 1, wherein the torque adjusting mechanism includes a driving member connected with the seat, the driving member being formed as a screw thread that is engaged with the coupling member, a rotation of the driving member causing a sliding displacement of the coupling member relative to the seat via engagement of the coupling member with the screw thread.

8. The infant chair apparatus according to claim 7, wherein the driving member has an end affixed with a rotary knob.

9. The infant chair apparatus according to claim 7, wherein the torque adjusting mechanism further includes a stop member affixed with the seat, the stop member limiting a displacement of the coupling member along the driving member.

10. The infant chair apparatus according to claim 1, wherein the torque adjusting mechanism includes:

a driving member pivotally connected with the seat and having a first and a second end opposite to each other, the first end of the driving member being connected with the coupling member; and an actuator button connected with the second end of the driving member, the actuator button being selectively engageable with the seat.

11. The infant chair apparatus according to claim 10, wherein the driving member is rotatable to modify the position of the coupling member relative to the seat.

12. The infant chair apparatus according to claim 10, wherein the connection between the driving member and the coupling member allows a limited displacement of the coupling member relative to the driving member during rotation of the driving member.

13. The infant chair apparatus according to claim 10, wherein the actuator button is movable radially relative to a rotation axis of the driving member, and has an engaging protrusion that engages with any of a plurality of grooves provided on the seat to rotationally lock the driving member.

14. The infant chair apparatus according to claim 13, wherein the torque adjusting mechanism further includes a second spring respectively connected with the actuator button and the driving member, the second spring biasing the engaging protrusion to engage with any of the grooves.

15. The infant chair apparatus according to claim 1, wherein the spring has a first end affixed with the support frame and a movable second end connected with the torque adjusting mechanism, the torque adjusting mechanism includes a second spring having a first end connected with the support frame and a second end connected with the coupling member.

16. The infant chair apparatus according to claim 1, further including:

a recline adjusting mechanism connected with the seat for locking the seat with the support frame, and unlocking the seat to allow adjustment of an inclination of the seat; and a switch disposed on the seat and operatively connected with the recline adjusting mechanism, wherein the switch is movable between a swing enabling state in which the recline adjusting mechanism is held in an unlocking state and a locking movement of the recline adjusting mechanism is blocked, and a swing disabling state in which movement of the recline adjusting mechanism is allowed to move to a locking state for locking the seat in place.

17. The infant chair apparatus according to claim 16, wherein the recline adjusting mechanism includes:

a latch assembled with the seat, the latch being movable to engage with any of a plurality of locking openings provided in the support frame at different radial positions relative to the pivot axis;

a handle assembled with the seat, the handle being actuated to cause the latch to disengage from any of the locking openings; and a transmission member connecting the latch with the handle.

18. The infant chair apparatus according to claim 17, wherein the switch is assembled adjacent to the handle.

19. The infant chair apparatus according to claim 18, wherein the switch is pivotally connected with the seat and has a radial arm, the radial arm being operable to rotate between a first position where the radial arm pushes the handle upward corresponding to the swing enabling state, and a second position where the radial arm lies substantially horizontal and allows a locking displacement of the handle.

20. The infant chair apparatus according to claim 16, being configured as an infant high chair when the switch is in the swing disabling state.

* * * * *